US009033176B2

(12) United States Patent
Liistro et al.

(10) Patent No.: US 9,033,176 B2
(45) Date of Patent: May 19, 2015

(54) WASTE DISPOSAL APPARATUS

(71) Applicant: Moderntake Product Solutions, LLC, Doylestown, PA (US)

(72) Inventors: Brenda O'Grady Liistro, Westport, CT (US); Marta Lorenzoni-Loeb, Hingham, MA (US); Joseph M Clark, London, OH (US); Paul David Maguire, Goochland, VA (US); David Stowers, Morristown, NJ (US); Jeffrey Joss, Union City, NJ (US); Henry Mack, Phillipsburg, NJ (US); Michael Zambelli, Basking Ridge, NJ (US)

(73) Assignee: MODERNTAKE PRODUCT SOLUTIONS, LLC, Doylestown, PA (US)

( * ) Notice: Subject to any disclaimer, the term of this patent is extended or adjusted under 35 U.S.C. 154(b) by 0 days.

(21) Appl. No.: 14/210,275

(22) Filed: Mar. 13, 2014

(65) Prior Publication Data

US 2014/0263348 A1 Sep. 18, 2014

Related U.S. Application Data

(60) Provisional application No. 61/798,121, filed on Mar. 15, 2013.

(51) Int. Cl.

| | |
|---|---|
| ***B65D 25/16*** | (2006.01) |
| ***B65F 1/06*** | (2006.01) |
| ***B65F 1/10*** | (2006.01) |

(Continued)

(52) U.S. Cl.

CPC ..... *B65F 1/06* (2013.01); *B65F 1/0006* (2013.01); *B65F 1/002* (2013.01); *B65F 1/004* (2013.01); *B65F 1/10* (2013.01); *B65F 1/141* (2013.01); *B65F 1/1607* (2013.01); *B65F 1/1623* (2013.01); *B65F 1/1638* (2013.01); *B65F 1/1646* (2013.01);

(Continued)

(58) Field of Classification Search

USPC ..... 220/495.06, 495.07, 495.08, 495.1, 220/495.11, 629

See application file for complete search history.

(56) References Cited

U.S. PATENT DOCUMENTS

| | | | | |
|---|---|---|---|---|
| 4,953,732 | A | 9/1990 | Cocks | |
| 5,022,548 | A * | 6/1991 | Stakis | 220/23.83 |

(Continued)

FOREIGN PATENT DOCUMENTS

| | | |
|---|---|---|
| DE | 20212283 | 12/2003 |
| WO | WO 2004/083046 | 9/2004 |

(Continued)

OTHER PUBLICATIONS

Notification of Transmittal of the International Search Report and the Written Opinion of the International Searching Authority, Or the Declaration, mailed on Aug. 1, 2014, 14 pages.

*Primary Examiner* — Mickey Yu
*Assistant Examiner* — Niki Eloshway
(74) *Attorney, Agent, or Firm* — Davis Wright Tremaine LLP

(57) ABSTRACT

A waste disposal apparatus, such as a waste disposal container or unit that is configured to receive used personal care products in a discreet and sanitary manner. Instances of incontinence, menstruation or uncontrollable bodily functions can be a personal situation that is otherwise unknown to others. However, current receptacles available to dispose of used personal care products fail to provide for a hygienic, easily accessible and discreet that is designed for small spaces, such as a home bathroom or public restroom stall.

17 Claims, 15 Drawing Sheets

(51) Int. Cl.
*B65D 90/00* (2006.01)
*B65F 1/00* (2006.01)
*B65F 1/14* (2006.01)

(52) U.S. Cl.
CPC ..... *B65F 2210/18* (2013.01); *B65F 2220/106* (2013.01)

(56) References Cited

U.S. PATENT DOCUMENTS 5,154,345 A * 10/1992 Shillington ..... 232/44
5,799,909 A 9/1998 Ziegler
6,120,743 A 9/2000 Papari
6,739,114 B2 5/2004 Shaffer
7,490,731 B2 2/2009 Hautop
7,696,711 B2 4/2010 Pollack et al.
8,087,532 B2 1/2012 Brown et al.
8,690,429 B1 4/2014 Germanow et al.
2007/0045324 A1 3/2007 Mitchell et al.
2010/0187235 A1* 7/2010 Chen ..... 220/495.06
2010/0301050 A1* 12/2010 Garland ..... 220/495.08
2011/0245793 A1 10/2011 Weinmann
2012/0294551 A1 11/2012 Ford

FOREIGN PATENT DOCUMENTS

WO WO 2005/120992 12/2005
WO WO 2013/134124 9/2013

* cited by examiner

WASTE DISPOSAL APPARATUS

CROSS REFERENCE TO RELATED APPLICATIONS

This non-provisional patent application claims the benefit of earlier filing date and right of priority to pending U.S. Provisional Patent Application No. 61/798,121, filed Mar. 15, 2013, entitled "Waste Disposal Apparatus." The contents of which are all hereby incorporated by reference herein in its entirety.

BACKGROUND

The market experiencing urinary incontinence (UI) is large; UI affects 200 million people worldwide, and is growing with the aging population with estimates of perhaps doubling by 2050, based on the incidence of pelvic floor disorders projected alone. There is embarrassment, as most women will not even discuss this with their health professional so they likely do not use correct products to help eliminate germs and odor. The feminine hygiene market is also large with over 60 million women in the prime menstruating years of 14-44 in the US alone. Disposing of feminine hygiene/menstrual or light bladder control products can be messy, awkward, and embarrassing, as well as cause problems with septic systems, water systems, old plumbing or with pets. Men and women with light bladder control incontinence often need to empty the trash frequently to prevent odor build up or embarrassment and some do not like to visit friends out of fear of having to put this product in a friend's trash.

SUMMARY

The instant invention relates generally to a waste containment system used in the disposal of adult bodily waste personal care products, such as male and female incontinence products, sanitary protection products, and similar personal care products.

BRIEF DESCRIPTION OF THE DRAWINGS

Various embodiments in accordance with the present disclosure will be described with reference to the drawings, in which:

FIG. 3B-2 is an illustrative example of a hanging disposal unit in accordance with at least one embodiment;

FIG. 3C-1 is an illustrative example of a hanging disposal unit in accordance with at least one embodiment;

FIG. 3C-2 is an illustrative example of a hanging disposal unit in accordance with at least one embodiment;

FIG. 5N-1 is an illustrative example of a cross-section view of a pouch-type disposal unit in accordance with at least one embodiment;

FIG. 5N-2 is an illustrative example of a cross-section view of a pouch-type disposal unit in accordance with at least one embodiment;

FIG. 5N-3 is an illustrative example of a cross-section view of a pouch-type disposal unit in accordance with at least one embodiment;

DETAILED DESCRIPTION OF THE INVENTION

Figures 1A, 1B, 1C:
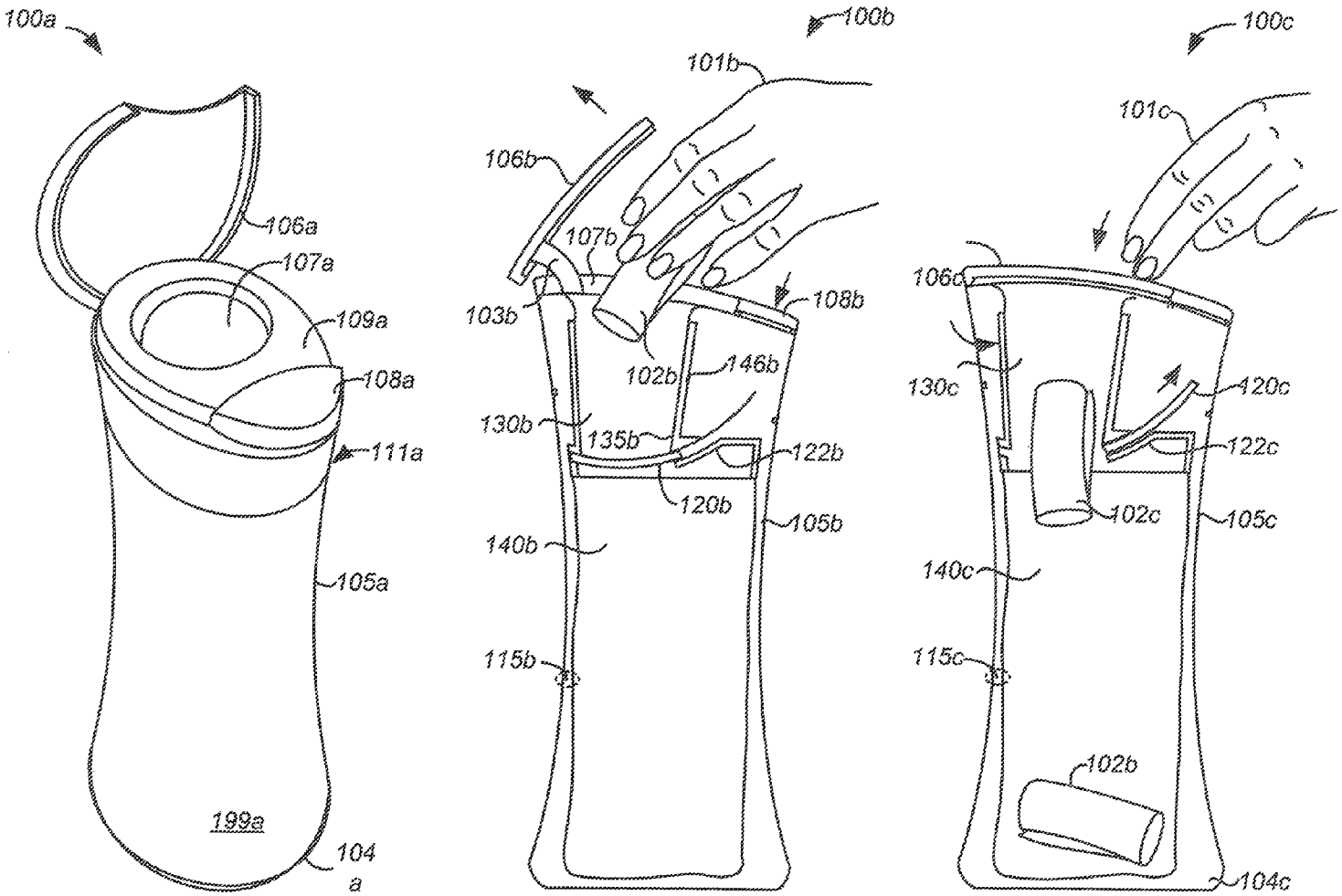
FIG. 1A are illustrative examples of a free-standing storage disposal unit in which various embodiments can be implemented.
FIG. 1B is an illustrative example of a free-standing storage disposal unit in which various embodiments can be implemented.
FIG. 1C is an illustrative example of a free-standing storage disposal unit in which various embodiments can be implemented.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Techniques described and suggested herein include system and apparatus directed to a waste disposal apparatus for discreet and hygienic disposal of used bodily waste products. Such embodiments include an apparatus configured to receive bodily waste products, such as tampons, pads, liners, briefs, condoms, wipes etc. (herein also referred to as "personal hygiene products," "personal care products," "bodily waste products," or "adult care products").

Containment storage includes disposable, reusable and refillable containers. Example embodiments of storage containers for disposing of personal hygiene products can include, for example, a multi-chambered, storage drop-in component, a honeycomb configured insert, a tube rotation expanded by a movement, trap-door units, a slide-and-drop refuse repository and many more example embodiments for temporarily storing discarded personal hygiene products.

These containers can be configured, in some example embodiments, to include an odor treatment and/or a hydro-proofing treatment such that any deposited used product will generally not emit a smell or leak a substance once put into the unit.

Additional types of waste disposal apparatuses can include portable or individual containers, referred to herein as "pods." Pods may vary in size for different sized feminine products, there could be one-size-fits-all pods or many sizes of pods that are correlated with different sizes of feminine hygiene products currently available. For example, as is known, there are many brands of feminine hygiene products, and the many brands make many different types and sizes.

Example embodiments of a pod can be manipulated with one hand but can be used with both hands in a manner that enables a user to dispose of the used personal hygiene product in a sanitary manner. The pods can be configured, in some example embodiments, to include an odor treatment and/or a hydro-proofing treatment such that any deposited used product will not emit a smell or leak a substance after the pod is closed. Example embodiments of a pod may include multiple different sealing mechanisms.

For example, panty-liners may be considered one of the smaller products and incontinence pad product may be considered one of the larger products. In addition, tampons also come in various shapes and sizes. However, one of the primary differences between disposing of a pad versus a tampon is the entire physical pad is thrown away, in addition to possibly the wrapper or other components of a new pad being replaced, whereas, for a tampon, often, only the applicator and possibly the wrapper are being disposed of in a container versus the toilet for the tampon itself. Therefore, example embodiments may include a specified different size or different products or a same-sized embodiment that is configured to be large enough for the largest, or approximate largest feminine hygiene product available.

Providing successful odor control of used personal hygiene products includes many possibilities. Example embodiments presented herein include mechanisms for controlling odor based on containment (e.g., sealing or using a barrier), neutralizing and masking.

Example embodiments presented herein, may include any number of odor control processes. Examples of odor control may include, a film with a heat seal, a film with a cohesive seal (e.g., cling wrap) and other methods of sealing a container (e.g., twist seals, zip seals, tin-tie tops, flap/flap seals). Alternative examples of possible odor control may include a honeycomb pocket or container, a rolling seal, a dip soiled material as a sealant, a membrane push through seal, and many additional methods currently known or hereinafter developed for the purposes of sealing compartments to retain odor.

Methods of odor control may need to address control and/or compensate for odors from chemicals impregnating the film, unit or component thereof, where using substances to counteract or prevent odors could include, for example, charcoal, oxidation, sprays, etc.

In addition to odor control, example embodiments are configured to provide for safety of absorbency, leakage, bacteria or other pathogens that may be a hazardous side effect of the used personal hygiene product. For example, absorbency and/or leakage may be compensated for, according to example embodiment, by using/employing hydrophobic materials that maintain different levels of absorbency or hydro-resistance.

In addition to absorbing concerns, used personal hygiene products can contain bio-hazardous materials that can carry and spread pathogens if not disposed of properly. For example, blood, uric acid, fecal matter and other bodily byproducts contained in or on a used personal hygiene product can contain bacteria from different customers such that improper disposal of these products may cause the spread of the bacteria. For example, currently, public restrooms for women generally have small metal containers with insufficient linings, including a small bag placed, but not secured, inside the container. Generally, public restrooms for men do not have anything other than a general garbage can that would be used to dispose of any personal hygiene products. The insufficient containment of such products can be considered a health and safety problem for those persons that must dispose of the contents of the garbage or containers, and can similarly be hazardous for other users of the products that may be exposed to a disposed product.

In addition to public hazards caused by the improper disposal of used personal hygiene products, largely due to insufficient resources/alternatives for disposal, households may similarly be exposed to such pathogens. Products merely placed in trashcans, even those with lids, and even if wrapped in toilet paper or plastic, can still catch the attention of children and pets. Example embodiments provide for a hygienic, discreet and private way of disposing of used personal hygiene products in a manner providing a healthy, private and safe way.

FIG. 1A is an illustrative example of a freestanding storage disposal unit in which various embodiments 100*a* can be implemented. According to one example embodiment, FIG. 1A includes a waste disposal apparatus 199*a* for use with personal hygiene products according to an example embodiment 100*a*. The waste disposal apparatus includes an outer base 104*a* and an upper rim 111*a* that operably interconnects the outer container 105*a* with the inner lid component 109*a*, such that in some example embodiments the inner lid is removable from the outer container. In alternative example embodiments, the base 104*a* can be removable from the outer container 105*a*, and in still other embodiments, both the inner lid and base are removable from the outer container 105*a*.

The inner lid 109*a* provides support for the cover 106*a*, which can be operably interconnected to the inner lid via a hinge (not shown). In an example embodiment in which the cover 106*a* is electronically attached to the inner lid 109*a*, a sensor 108*a* is connected to provide automatic opening functionality where the sensor can be powered via a battery or cord. When the cover is in an open position, as illustrated, an outer compartment opening 107*a* is available. The cover 106*a*, in some example embodiments is configured open in a vertical direction (as shown) and in some example embodiments the cover 106 can open via a horizontal motion.

Alternative example embodiments include activation mechanism for a top or entry location for a used product to be spring loaded and operated by foot, hand or pressure from the arm or knee, or battery powered. A motion detector may be used.

FIGS. 1B and 1C illustrate example embodiments of a cross section of waste disposal apparatus 199*a* in an open and closed position, respectively.

FIG. 1B illustrates an example embodiment of the waste disposal apparatus in an open position 100*b*. A user 101*b*, having already engaged the outer opening mechanism 108*b*, is able to dispose of a soiled personal hygiene product 102*b* into a first inner opening compartment 130*b*. In one example embodiment, the first inner opening compartment is located within an inner disposable collar being operably interconnected to a liner 115*b*, which is located internally to the outer container 105*b*, spanning the first inner opening compartment 140*b*, where the first and second inner opening compartments are separated by an inner movable gate 120*b*, which is illustrated in a closed position. In some example embodiments, the inner movable gate 120*b* is operable to open into an inner gate compartment 122*b*, where the inner gate compartment may, in some embodiments, be connected with an outer collar 145*b* (described in detail in FIG. 2B).

FIG. 1C illustrates an example embodiment of the waste disposal apparatus in a closed position 100*c*. The user 101*c*, having released the personal hygiene product (PHP) 102*b* into the first inner opening compartment 130*c* and moves the cover 106*c* to a closed position. At or around the point where the cover 106*c* is placed into the closed position, the cover or a component thereof (not shown) releases the inner movable gate 120*c* into the inner gate compartment 122*c*. In an example embodiment in which the inner movable gate 120*c* is in an open position (as shown in FIG. 1C), the PHP 102*c* is able to move from the first inner opening compartment 130*c* into the second inner opening compartment 140*c*, at which point the PHP 102*c* falls toward the bottom of the liner 115*c* located within the outer container 105*c*. In some example embodiments, at or around the point where the PHP 102*c* passes by or through the inner movable gate 120*c*, the inner movable gate returns to closed position (as illustrated in FIG. 1B). At which point, the contents of the liner 115*c* are no longer visible if the cover 106*c* were to be opened.

Figure 2B:
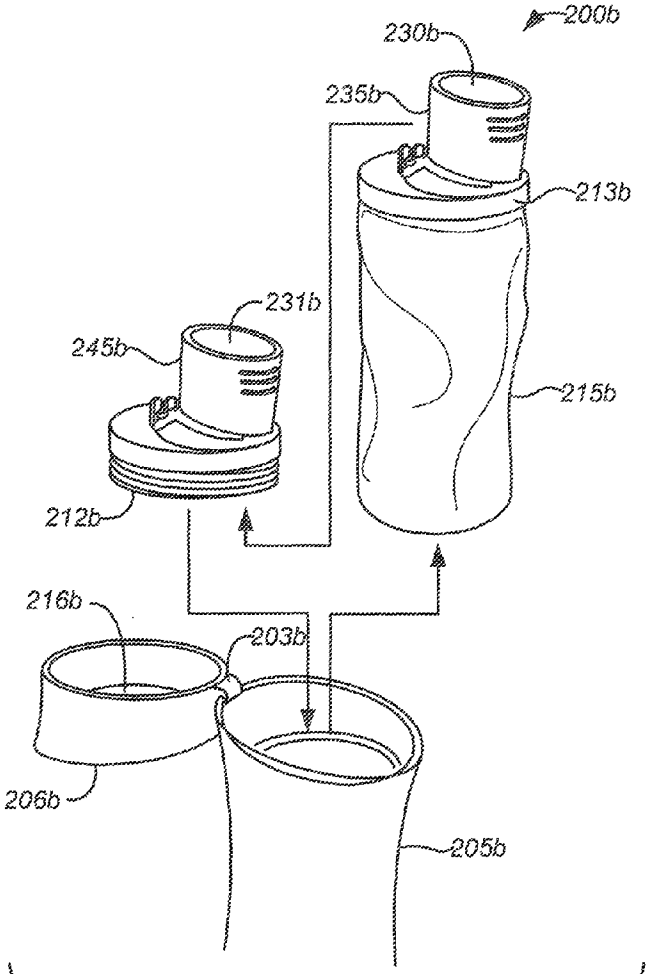
FIG. 2B is an illustrative example of a free-standing storage disposal unit in which various embodiments can be implemented.
Figure 2A:
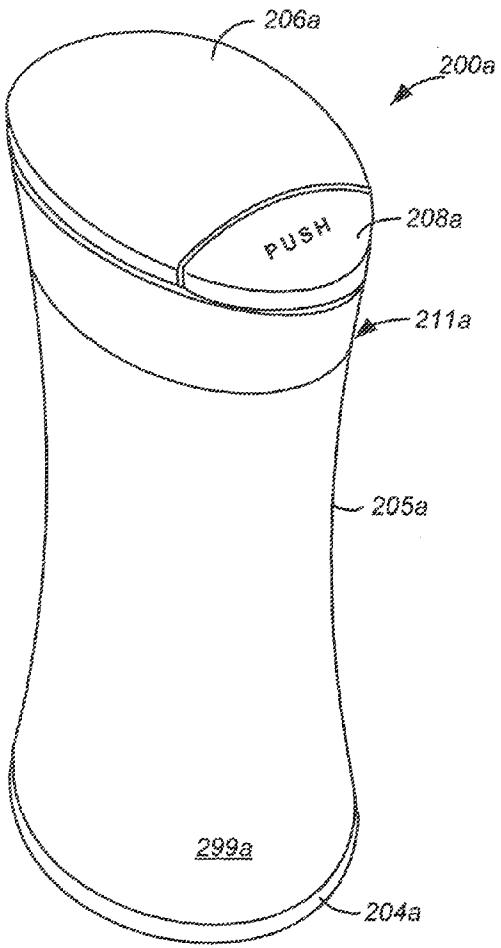
FIG. 2A is an illustrative example of a free-standing storage disposal unit in which various embodiments can be implemented.

FIG. 2A illustrates the waste disposal apparatus 299 in a closed position 200*a*. As in FIG. 1A, the waste disposal apparatus includes an outer container 205*a* operably interconnected between a base 204*a* and a rim of the container 211*a*. In the example embodiment of FIG. 2A, the cover 206*a* is configured to be opened by a manual operation, such as a push, of an outer opening mechanism 208*a*. In alternative example embodiments, the cover 206*a* can be opened manually by a pull on the outer opening mechanism.

FIG. 2B illustrates an example embodiment 200*b* of at least some of the internal components of the waste disposal apparatus 299. The outer container 205*b* is interconnected with the cover 206*b* via a hinge 203*b*. In alternative example embodiments, the cover and the outer container could be interconnected in another manner. In the example embodiment of FIG. 2B, the waste disposal apparatus 299 includes two components, a liner 215*b* (with additional components) and an outer collar 245*b*. The liner 215*b* is interconnected with an inner always-concealed top, composed of, at least one embodiment, an inner collar 235*b* and an inner collar seal 213*b*. In some example embodiments, the inner collar 235*b* and the inner collar seal 213*b* are a single integrated component. In the example embodiment of FIG. 2B, the liner 215*b* and interconnected components are configured to be placed inside the outer container 205*b*.

The outer collar 245*b*, which can be operably interconnected with an outer interlocking mechanism 212*b*, are configured to be placed over or on top of the liner 215*b* (and associated interconnected components 235*b* and 213*b*). The outer interlocking mechanism 212*b* can, in some example embodiments be connected with the outer container 205*b* via a twisting motion or a snapping motion or can be one piece.

In an example embodiment in which the liner 215*b* is located inside the outer container 205*b* and the outer collar 245*b* is closed or covered over the liner, the inner opening compartment of the outer collar 245*b* create an opening into the liner 215*b*. The opening can be covered when the cover 206*b* is in the closed position (as illustrated in FIG. 2A).

In some example embodiments, the liner 215*b* and interconnected components 235*b* and 213*b* can be disposable such that the contents of the liner 215*b*, such as any PHP are never touched. As illustrated in FIG. 1B and 1C, the inner movable gate (not shown) is located within the inner collar such that the opening and closing of the gate is accomplished as illustrated and described in connection with FIGS. 1B and 1C.

Figures 2, 3B:
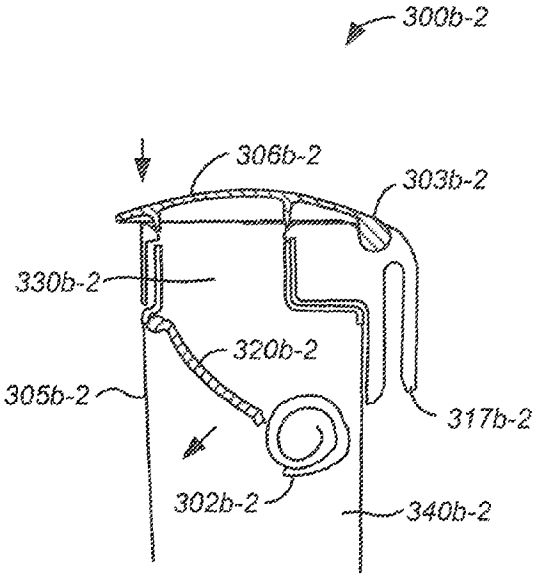
Figures 1, 3B:
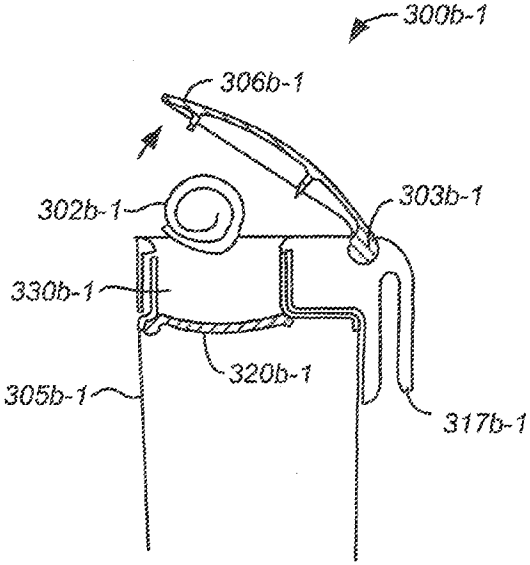
FIG. 3B-1 is an illustrative example of a hanging disposal unit in accordance with at least one embodiment.
Figure 3A:
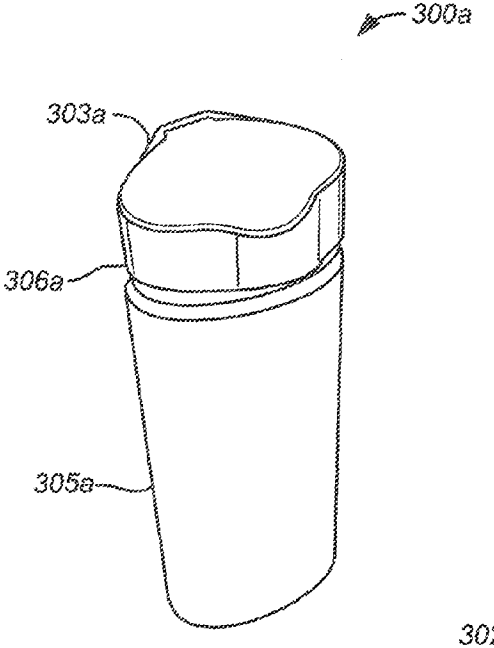
FIG. 3A is an illustrative example of a hanging disposal unit in accordance with at least one embodiment.

FIG. 3A is an illustrative example of waste disposal apparatus in a closed position 300*a* according to at least one embodiment. An example embodiment of the waste disposal apparatus includes an outer container 305*a* operably interconnected to an outer cover 306*a*, where the outer container is attached to the cover by a hinge 303*a*. In alternative example embodiments, the outer container 305*a* being attached to the cover 306*a* via a screw top cover connected into threads of the cover, another example embodiment includes a cover that is a pull/push cover, which is opened via a user by pulling on the cover away from the outer container.

FIG. 3B-1 is an illustrative example of a cross-section view 300*b*-1 of a waste disposal apparatus in accordance with at least one embodiment. An example embodiment of the waste disposal apparatus can include an outer container being operatively connected to a cover 306*b*-1 by a screw-hinge 303*b*-1, and where the outer container is further operatively coupled a handle 317*b*-1. In some example embodiments, the hinge 303*b*-1 is located on the handle 317*b*-1, and one method of opening the cover of the outer container is to push on the back of the cover manually in the direction of the handle.

Alternative example embodiments of the FIG. 3B-1 include a user (not shown) manually lifting the cover 306*b*-1 in order to dispose of a personal hygiene product 302*b*-1. In one example embodiment, the personal hygiene product 302*b*-1 is placed into a first inner opening compartment 330*b*-1, where it will remain until the cover is closed. In some example embodiments, the cover 306*b*-1 is configured to close automatically without further user input. In other example embodiments, while the cover 306*b*-1 is in an open position, the personal hygiene product 302*b*-1 remains in the first inner opening compartment 330*b*-1 due to the inner moveable gate 320*b*-1 being in a closed position. In the example embodiment, at or near the time the cover 306*b*-1 closes, the inner moveable gate 320*b*-1 is configured to drop to an open position (see FIG. 3B-2). FIG. 3B-2 illustrates a waste disposal apparatus with a cover in a closed position 300*b*-2 in accordance with at least one embodiment. In the example embodiment of FIG. 3B-2, the waste disposal device includes an outer container 305*b*-2 being operably interconnected with a handle 317*b*-2 and a cover 306*b*-2. In some example embodiments, the handle can be an integrated part of the container, such that the handle and container were molded together. After the personal hygiene product 302*b*-2 is placed into the first inner compartment 330*b*-2, and the cover 306*b*2 is closed, an inner movable gate 320*b*-2 reacts to the cover closing by dropping from a closed position to an open position. In response to the inner movable gate opening, the personal hygiene product 302*b*-2 having been located in the first inner compartment 330*b*-2, falls into the second inner compartment 340*b*-2. In some example embodiments, the inner moveable gate 320*b*-2 may be attached to a spring mechanism (not shown), such that the inner movable gate returns to a closed position after the personal hygiene product 302*b*-2 has moved from the first inner compartment 330*b*-2 to the second inner compartment 340*b*-2. Alternative example embodiments include the gate 320*b*-2 being mechanically returned to a closed position, such as using a counterweight or through gravity.

Figure 3D:
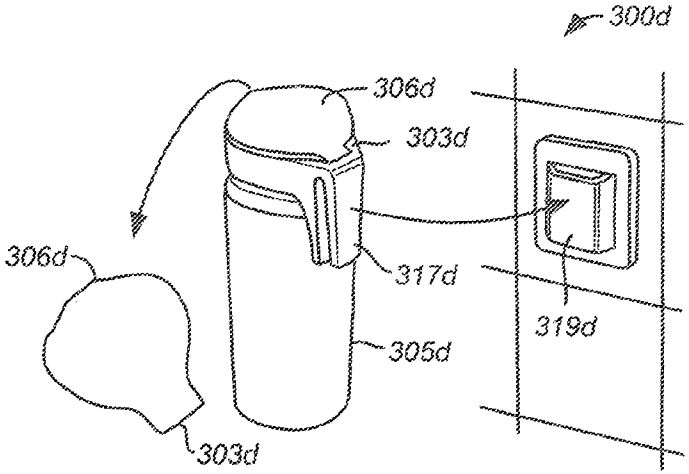
FIG. 3D is an illustrative example of a hanging disposal unit in accordance with at least one embodiment.
Figures 2, 3C:
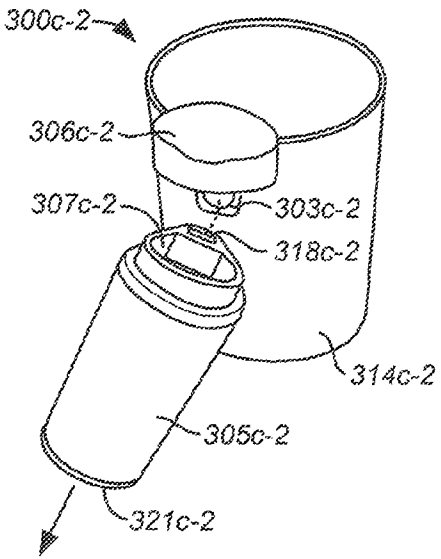
Figures 1, 3C:
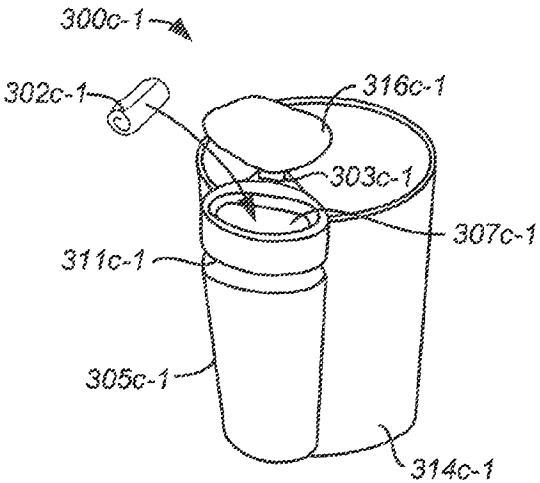

FIG. 3C-1 illustrates a waste disposal apparatus hanging 300*c*-1 from a garbage pail in accordance with at least one embodiment. The example embodiment includes a garbage pail 314*c*-1 being used as a supporting device to hang an embodiment of the waste disposal device. More specifically, in example embodiment of FIG. 3C-1, a container 305*c*-1 is interconnected with a rim of a container 311*c*-1, which is further interconnected with a cover (the embodiment of FIG. 3C-1 illustrating the underside of the cover, labeled 316*c*-1) via a hinge or other connection mechanism 303*c*-1. In the example embodiment, the container cover, when in an open position provides for an outer compartment opening 307*c*-1 through which a user can dispose of a personal hygiene product 302*c*-1.

FIG. 3C-2 illustrates a waste disposal apparatus hanging 300*c*-2 un-mounted from a garbage pail in accordance with at least one embodiment. The example embodiment includes a garbage pail 314*c*-2 being used as a supporting device for which the outer container 305*c*-2 was interconnected with, possibly via a handle, such as the handle 317*b*-1 as described in connection with FIG. 3B-1. The example embodiment disclosing the outer container being interconnected with a removable base 321*c*-2 and a cover 306*c*-2 connected via a removable hinge 318*c*-2. In other words, the outer container 305*c*-2 can be decoupled from the base and the cover in order to provide, for example, a method of releasing an inner liner (not shown), such as the liner 215 as described and illustrated in connection with FIG. 2B and replacing the removed liner with a fresh liner.

Alternative example embodiments, the container 305*c*-2 could contain a liner which when filled with soiled personal hygiene products, can be removed and replaced with a fresh liner without a user having to view or touch the soiled products. For example, the liner may be an opaque liner placed into the outer container 305*c*-2 via an outer compartment opening 307*c*-2 or the liner could be placed into the outer container via the opening formed when the base 321*c*-2 is removed from the container. When a liner is being removed from the opening formed by the removal of the base 321*c*-2, the user can drop the lining through the outer container and twist the bag as reaches the bottom using a twist mechanism inside the bottom portion of the outer container. In such an example embodiment, the user has released the liner bag, possibly according to a releasing mechanism on the outside of the outer container or the cover, allowed the liner bag to drop through the bottom of the outer container, and close the bag without ever having seen the contents.

FIG. 3D is an illustrative example of a hanging disposal unit in accordance with at least one embodiment. The outer container 305*d* can be created in a number of sizes based on an attachment point, where the attachment point could be a small hook, such the holding attachment component 319*d* or a larger object such as a shelf, a doorframe, a toilet bowl or the like. The example embodiment of FIG. 3D discloses a back-side view of the waste disposal apparatus, including an outer container 305*d*, a handle 317*d*, a cover 306*d*, and a hinge 303*d*, where the cover and hinge are shown in an expanded view.

Alternative embodiments are capable of being combined with or coated with an adhesive mechanism to create a seal over the entire surface or a portion thereof that allows for easy attachment, removal or replacement of the entire container or any component thereof For example, such examples of the container may be used or attached to a wall component 319*d*, shelf, door, or other available surface within ease of access to the (toilet) such that the unit may be attached thereto and removed or replaced at the need or convenience of the user. Such example embodiments may be a reusable container or a disposable container. Alternative example embodiments of the present invention can include an apparatus or receptacle being interconnected with or attached to a home/office surface that is non-harmful to the surface, such as through hanging or suction.

Figure 4A:
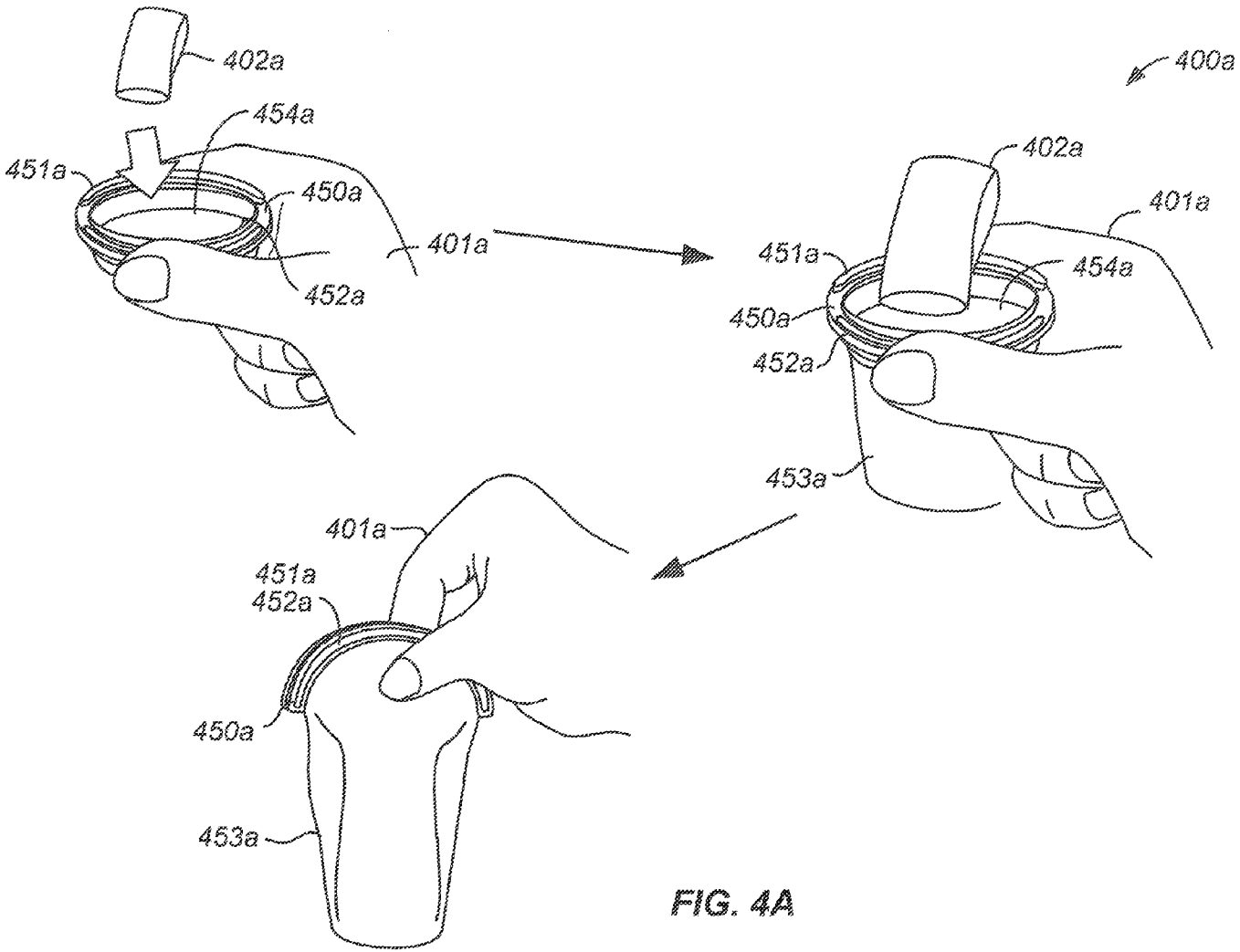
FIG. 4A is an illustrative example of a portable pod-type disposable disposal unit accordance with at least one embodiment.

FIG. 4A is an illustrative example of a portable pod-type disposal cartridge 400*a* accordance with at least one embodiment. At a first step, labeled 1 of FIG. 4A, a user 401*a* is holding a pod-type disposal apparatus in a flat position. In some example embodiments, the pod may arrive from a manufacturer in a flat stored position or in another form, similarly the pod may arrive in a flat stored position inside a small container, such as a plastic or paperboard container to protect the pod. Continuing at step 1, the pod includes a hinge component 450*a*, a center compartment 454*a*, which at Step 1 has little to no volume in the flat store position, and two edges, one may be a male edge, such as the raised ridge 451*a* and one may be a female edge, such as the recessed ridge 452*a*.

Further example embodiments of FIG. 4A include the pod closure being a sealing surface, where the closure may include tape or surfaces that adhere when pressed together. Alternative example embodiments include multiple forms closure materials in order to ensure a waterproof and odor-free, or nearly waterproof and/or nearly odor-free seal. The rim 450*a* may further include a thermo-form flange or other compression molding mechanism for interconnecting two sides of a component. Continuing the example embodiment of FIG. 4A, the user 401*a* may be placing a personal hygiene product 402*a* into the pod opening 454*a*, at which point, moving to Step 2, the user may push onto the pod opening 454*a*, with even a small amount of pressure, in order to expand the extendable compartment 453*a* of the pod. As the user 401*a* places the personal hygiene product 402*a* into the pod extendable compartment in its entirety, the user 401*a*, moving to Step 3, can close the two halves 451*a* and 452*a*, at the living hinge 450*a*, in order to seal the pod disposal apparatus completely.

Figure 4B:
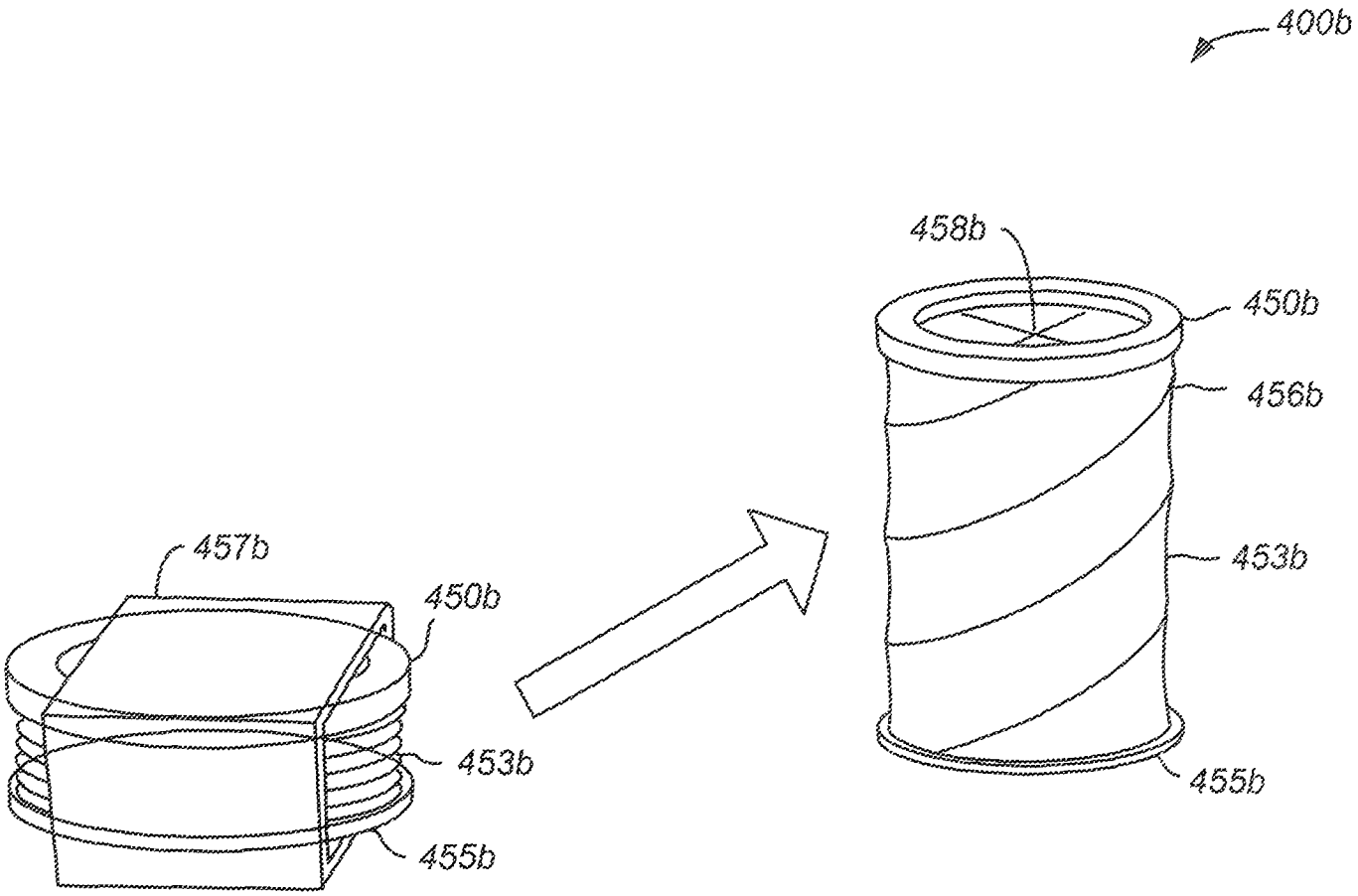
FIG. 4B is an illustrative example of an expandable type disposable disposal unit accordance with at least one embodiment.

FIG. 4B is an illustrative example of an expandable cartridge-type disposal unit 400*b* accordance with at least one embodiment. The disposal unit may include a pod-holding component 457*b*, such as a plastic, paperboard or other suitable material, for containing the pod in a flattened state for travel. In the example embodiment of FIG. 4B, the pod may include a top rim 450*b*, a bottom rim 455*b* and an extendable compartment 453*b*. At a time when a user, such as the user 401*a* described and illustrated in connection with FIG. 4A, decides to use the pod, the user would remove the pod-holding component 457*b* and the pod would "spring" open. For example, one embodiment of the pod of FIG. 4B may include structured ribs 456*b* that cause the pod to effectively unwind into a standing form upon release from its enclosure. The pod may contain a diaphragm-type trap 458*b* for a user to place a product to dispose of, in which the diaphragm traps the product inside. The pod of FIG. 4B may also contain a double-sided bag, such that it provides for additional strength, odor-protection, and sealability. In alternative example embodiments of the pod, the pod in its extended form may include a rigid bezel and a rigid base in order to support the structure from falling to a side or rolling over, possibly causing the contents to move or shift.

Figures 1, 5B:
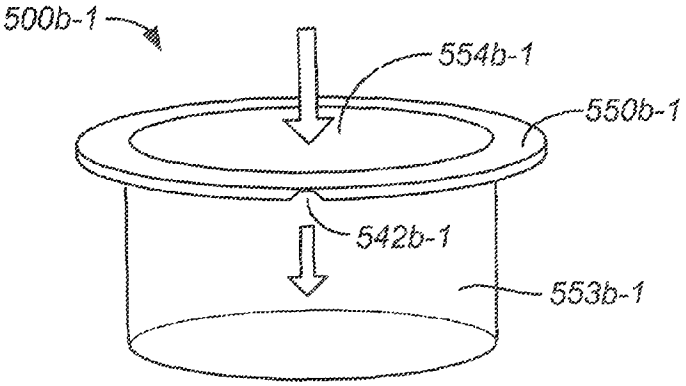
FIGS. 5A-5D are illustrative examples of a portable pod-type disposable disposal unit in accordance with at least one embodiment.
Figure 5A:
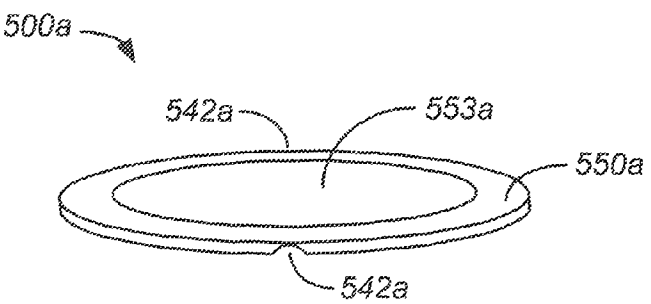
Figures 2, 5B:
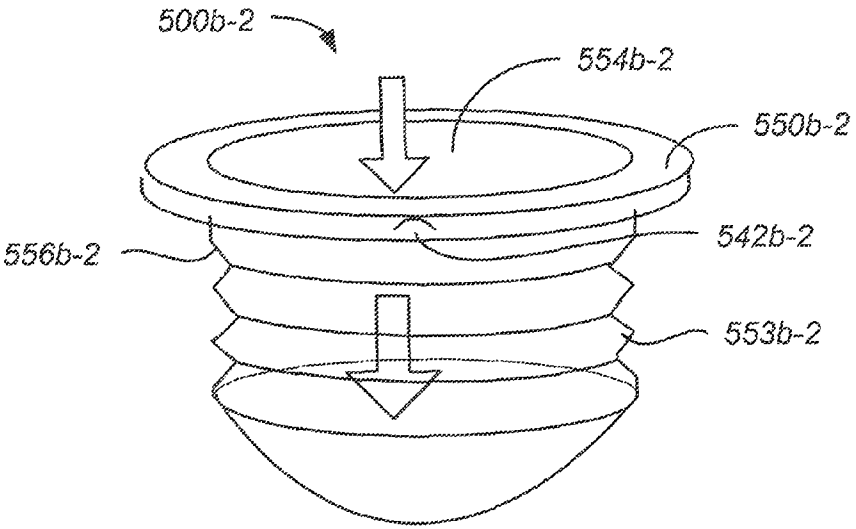

FIG. 5A is an illustrative example of a portable pod-type disposal cartridge in accordance with at least one embodiment 500*a*. According to the example embodiment, a pod in which a semi-rigid rim 550*a*, which is operably interconnected with a compressed and/or flattened flexible bag-like component 553*a*. The rim 550*a* and the bag-like component 553*a* either may be formed from the same material, or may be different materials that are joined or sealed together. The rim 550*a* has an integrated hinging feature 542*a* (that is formed within the rim). In some example embodiments, the hinging feature may be of a same material as the rim itself, or may be formed using other material(s).

FIG. 5B-1 is an illustrative example of a portable pod-type disposal cartridge in accordance with at least one embodiment 500*b*-1. FIG. 5B-1 illustrates similar elements and components of FIG. 5A, including, the bag-like component 553*a* from FIG. 1 with the bag-like component 553*b*-1 being in an expanded position. The example embodiment further includes the opening of the pod, 554*b*-1 as the volume is increased based, at least, on the expansion. FIG. 5B-1 further illustrates the hinging feature of the pod, 542*b*-1 and the rim 550*b*-1 of the pod. Expansion of the bag-like component 553*b*-1 may occur through manual expansion by the user or may occur when the pod is removed from container. When expanded, the bag-like component 553*b*-1 forms an interior volume of sufficient size to contain at least one type of refuse placed inside the bag-like component 553*b*-1.

FIG. 5B-2 is an illustrative example of a portable pod-type disposal cartridge in accordance with at least one embodiment 500*b*-2. The example embodiment of FIG. 5B-2 illustrates similar components and elements as illustrated and described in connection with FIG. 5B-1, including, for example, the opening of the pod, 554*b*-2 as the volume is increased based, at least, on the expansion. FIG. 5B-2 further illustrates the hinging feature of the pod, 542*b*-2 and the rim 550*b*-2 of the pod, and with the bag-like component 553*b*-2 expanded. In this example embodiment, the bag like component 553*b*-2 is formed with pleats 556*b*-2 or other geometric feature(s) to facilitate easy expansion of the portable pod-type disposal apparatus. Example embodiments of the pleats 556*b*-2 or other geometric feature(s) also offer additional expansion volume at the sides and base of the bag like component 553*b*-2.

Figure 5C:
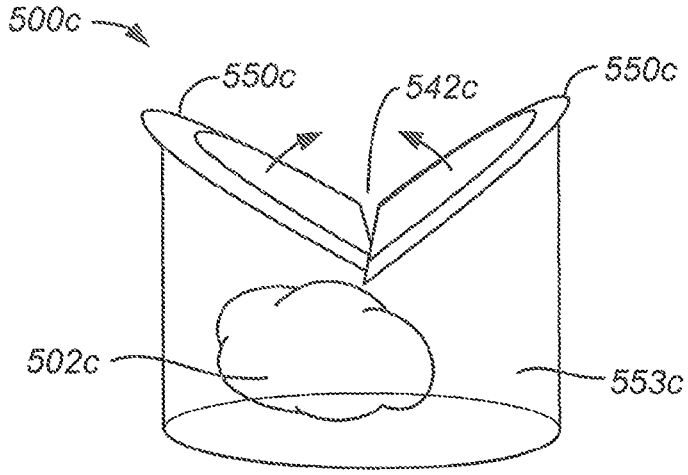

FIG. 5C is an illustrative example of a portable pod-type disposal cartridge in accordance with at least one embodiment 500*c*. The example embodiment of FIG. 5C includes similar elements as described and illustrated in connection with FIGS. 5A, 5B-1, and 5B-2, in which the example embodiments illustrated the pod-type disposal apparatus being closed via a folding at hinging feature 542*c*. As the closing is performed, the two sides of the rim 550*c* move toward each other, after a user would place personal hygiene products 502*c* into the interior volume of the pod-type disposal apparatus.

Figure 5D:
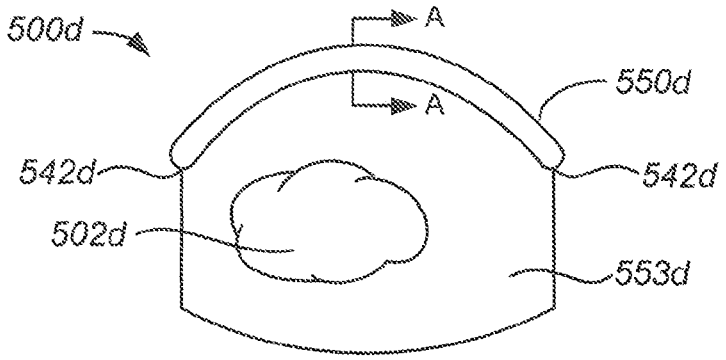

FIG. 5D is an illustrative example of a portable pod-type disposal cartridge in accordance with at least one embodiment 500*d*. The example embodiment of FIG. 5D illustrates similar components and elements as FIGS. 5A-5C, including in which the example embodiments illustrated the pod-type disposal apparatus being closed via a folding at hinging feature 542*d*. As the closing is performed, the two sides of the rim 550*d* move toward each other, after a user would place personal hygiene products 502*d* into the interior volume of the pod-type disposal apparatus. FIG. 5D further illustrates the portable pod-type disposal apparatus being in a fully closed position, such that the two sides of the rim 550*d* are interlocked in some manner. In some example embodiments, when the folded halves of the rim 550*d* are engaged with each other, the two sides create a water and odor resistant seal.

In an alternative example embodiment of the pod-type disposal apparatus, the pod or components thereof may be formed or manufactured using a variety of materials, for example: manmade fiber materials such as non-woven materials; manmade materials, such as plastic resin like Styrene, Polyethylene and Polypropylene; natural fibers, such as paperboard and bamboo (virgin and recycled); hydrophobic coatings that prevent moisture leakage; manmade and natural anti-microbial agents, to prevent bacterial growth (coating and additive).

FIGS. 5E-5H illustrate cross-section views A-A of FIG. 5D. The example embodiments of FIGS. 5E-5H include all or most of the same components as the example embodiments of FIGS. 5A-5D; however, the below example embodiments describe various methods to attain a water and odor-resistant seal when the rim 550*d* is folded together as illustrated in FIG. 5D.

Figure 5E:
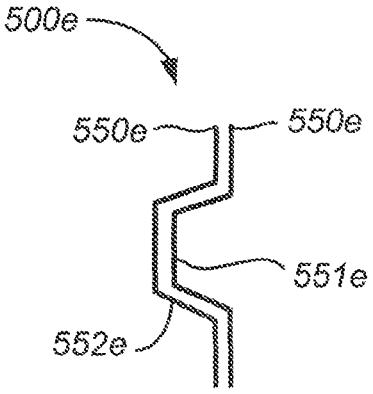
FIGS. 5E-5H are illustrative examples of a cross section of a pod-type disposal in accordance with at least one embodiment.

FIG. 5E is an illustrative example of a cross section 500*e* of a pod-type disposal cartridge in accordance with at least one embodiment. The example embodiment of FIG. 5E illustrates a rim 550*e* including one or more male/female engagement ribs and channels, such that a male rib 551*e* is pressed to fit by the user into the female channel 552*e* in order to form a seal. However, in this example embodiment, the male rib 551*e* fails to penetrate or fully penetrate the female channel 552*e* causing the seal to fail.

Figure 5F:
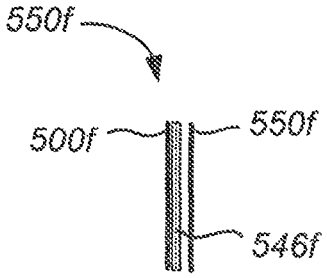

FIG. 5F is an illustrative example of a cross section 500*f* of a pod-type disposal cartridge in accordance with at least one embodiment. The example embodiment of FIG. 5F illustrates a rim 550*f* including a one- or two-part adhesive, such that the two adhesive members 546 form a seal when in contact with each other.

Figure 5G:
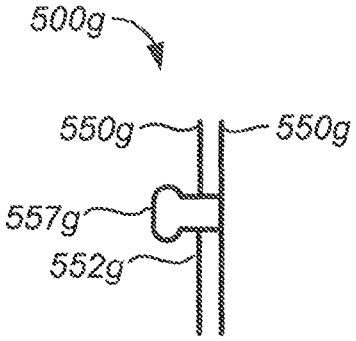

FIG. 5G is an illustrative example of a cross section 500*g* of a pod-type disposal cartridge in accordance with at least one embodiment. The example embodiment illustrates a rim 550*g* including one or more male/female engagement rib(s) and channel(s). In the example embodiment of FIG. 5G, the male rib(s) 551*g* is press fit by the user into female channel(s) 552*g* to form the seal with the male rib(s) 551*g* penetrating the female channel(s) 552*g* fully. The male features above could be one or more "POSTS" instead of ribs (with a matching change to the female portion).

Figure 5H:
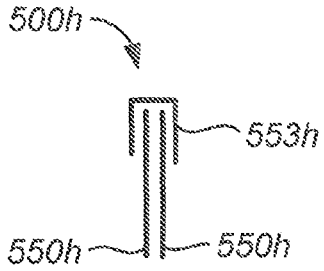

FIG. 5H is an illustrative example of a cross section 500*h* of a pod-type disposal cartridge in accordance with at least one embodiment. The example embodiment illustrates the rim 550*h* being sealed or closed with one or more external clips to be provided with the pod or in connection with the pod. In the example embodiment, the clip 553*h* is a separate component from the pod; however, alternative example embodiments may include a clip being operably interconnected with the pod or being an integral feature of the rim.

Figure 5I:
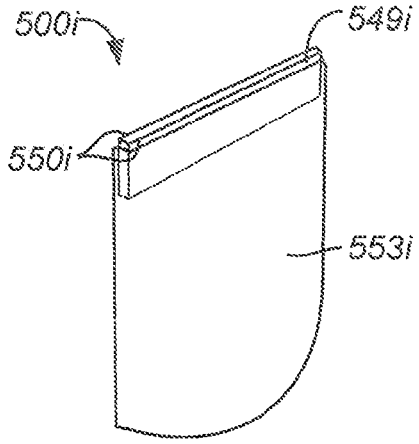
FIGS. 5I-5M are illustrative examples of a pouch-type disposable disposal cartridge in accordance with at least one embodiment.

FIG. 5I is an illustrative example 500*i* of a pouch-type disposal cartridge in accordance with at least one embodiment. The example embodiment discloses an alternative style of a pod disposal apparatus in which a semi-rigid rim, which is attached to a compressed/flattened flexible bag-like component 553*i*. The rim 550*i* and the bag-like component 553*i* either may be formed from the same material, or may be different materials that are joined or sealed together. The rim 550*i*, in some example embodiments, may be configured to have an integrated flexing feature(s) 549*i* (that may be formed within the rim). The flexing feature may be of same material as the rim itself, or may be formed using other material(s).

Figure 5J:
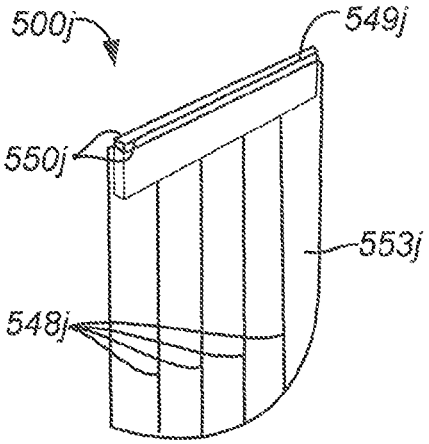

FIG. 5J is an illustrative example 500*j* of a pouch-type disposal cartridge in accordance with at least one embodiment. The example embodiment discloses similar elements as the embodiment in FIG. 5I; however, the bag like component 553*j* is formed with pleats, folds, or other geometric feature(s) 548*j* to facilitate easy expansion. The pleats, folds, or other geometric feature(s) may also offer additional expansion volume at the sides and base of the bag like component.

Figure 5K:
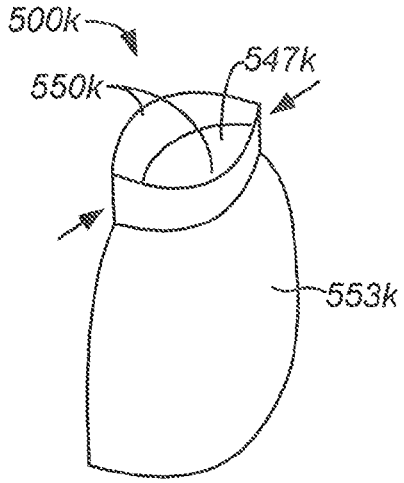

FIG. 5K is an illustrative example 500*k* of a pouch-type disposal cartridge in accordance with at least one embodiment. The example embodiment discloses similar elements as the embodiment in FIG. 5I and 5J with the bag-like component 553*k* in an expanded state. In some example embodiments, expansion of the bag-like component occurs through manual expansion by the user when the user applies a squeezing/compression force to the flexing feature(s). In the example embodiment of FIG. 5K, the user's applied force causes the rim component 550*k* to flex and open. When the bag-like component is opened, it forms an interior volume of sufficient size to contain at least one personal hygiene product inside the bag-like component.

Figure 5L:
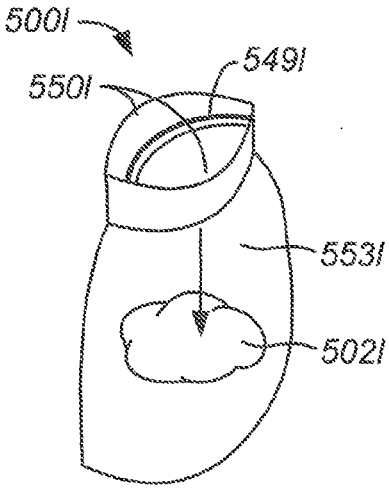

FIG. 5L is an illustrative example 5001 of a pouch-type disposal cartridge in accordance with at least one embodiment. The example embodiment discloses similar elements as the embodiment in FIG. 5I and 5J with the bag-like component 553*k* in an expanded state. In some example embodiments, the bag-like component is being held open via force applied at the flexing feature 5491 and after user would place personal hygiene products 5021 into the interior volume.

Figure 5M:
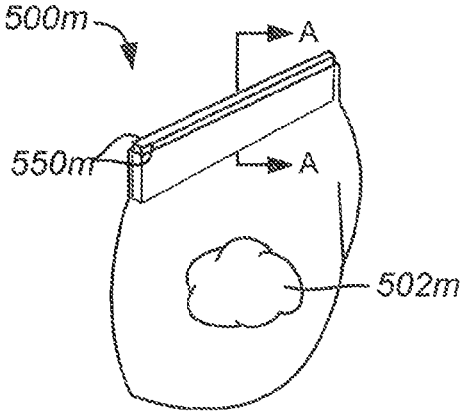

FIG. 5M is an illustrative example of a pouch-type disposal cartridge in accordance with at least one embodiment 500*m* that illustrates similar elements as the embodiment in FIG. 5L, where the bag-like component 553*k* is in an expanded state. In some example embodiments, the opening force is removed and the product is closed. When closed the halves of the rim 5501 are engaged to create a water and odor resistant seal.

FIGS. 5N-1, 5N-2, and 5N-3 illustrate similar elements as the embodiment in FIG. 5M in cross-section A-A but with various embodiments of methods to attain a water and odor resistant seal along rim 550*n*.

Figures 1, 5N:
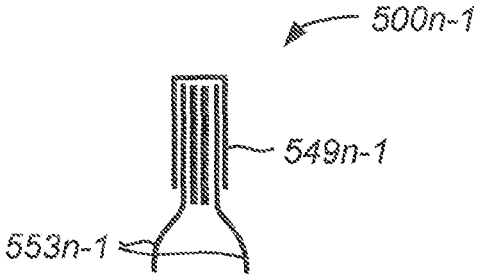
Figures 2, 5N:
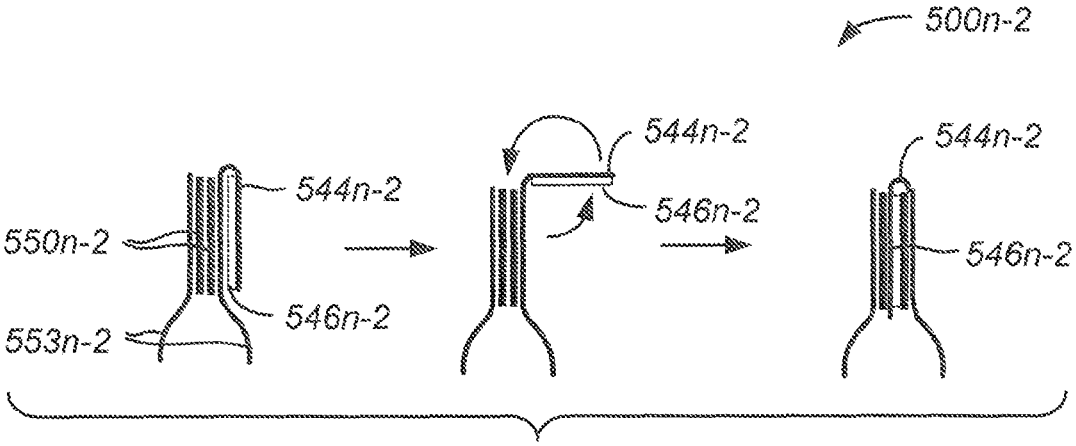

FIG. 5N-1 is an illustrative example of a cross-section view of a pouch-type disposal unit in accordance with at least one embodiment 500*n*-1. In the example embodiment, the rim 550*n*-1 is illustrated with an addition of a one or 2-part adhesive strip 546*n*-1. The one or 2-part adhesive strip being separately supplied and applied by the user along the outside surfaces of the rim to facilitate sealing the pod.

FIG. 5N-2 is an illustrative example of a cross-section view of a pouch-type disposal unit in accordance with at least one embodiment 500*n*-2. The example embodiment illustrates the flexible bag-like component 553*n*-2 formed with an additional "flap" of material 544*n*-2, which extends from the top of the rim 553*n*-1. The flap 544*n*-2 and the bag-like component 553*n*-2 either may be formed from the same material, or may be different materials that are joined or sealed together. Flap 544*n*-2 further contains a one or two part adhesive 546*n*-2. When sealing the pod, the flap 544*n*-2 with adhesive 546*n*-2 is rotated into the space between the halves of the rim and pressed to form a seal.

Figures 3, 5N:
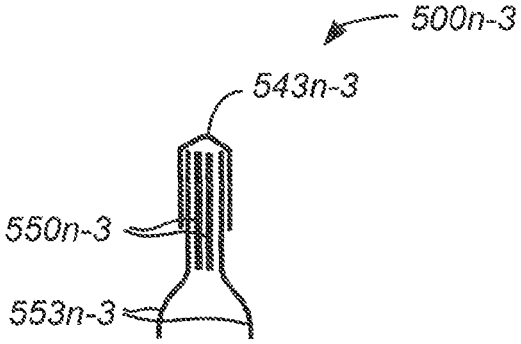

FIG. 5N-3 is an illustrative example of a cross-section view of a pouch-type disposal unit in accordance with at least one embodiment 500*n*-3. The example embodiment illustrates the rim 553*n*-3 sealed closed with one or more external clips to be provided with the pod.

Figure 6A:
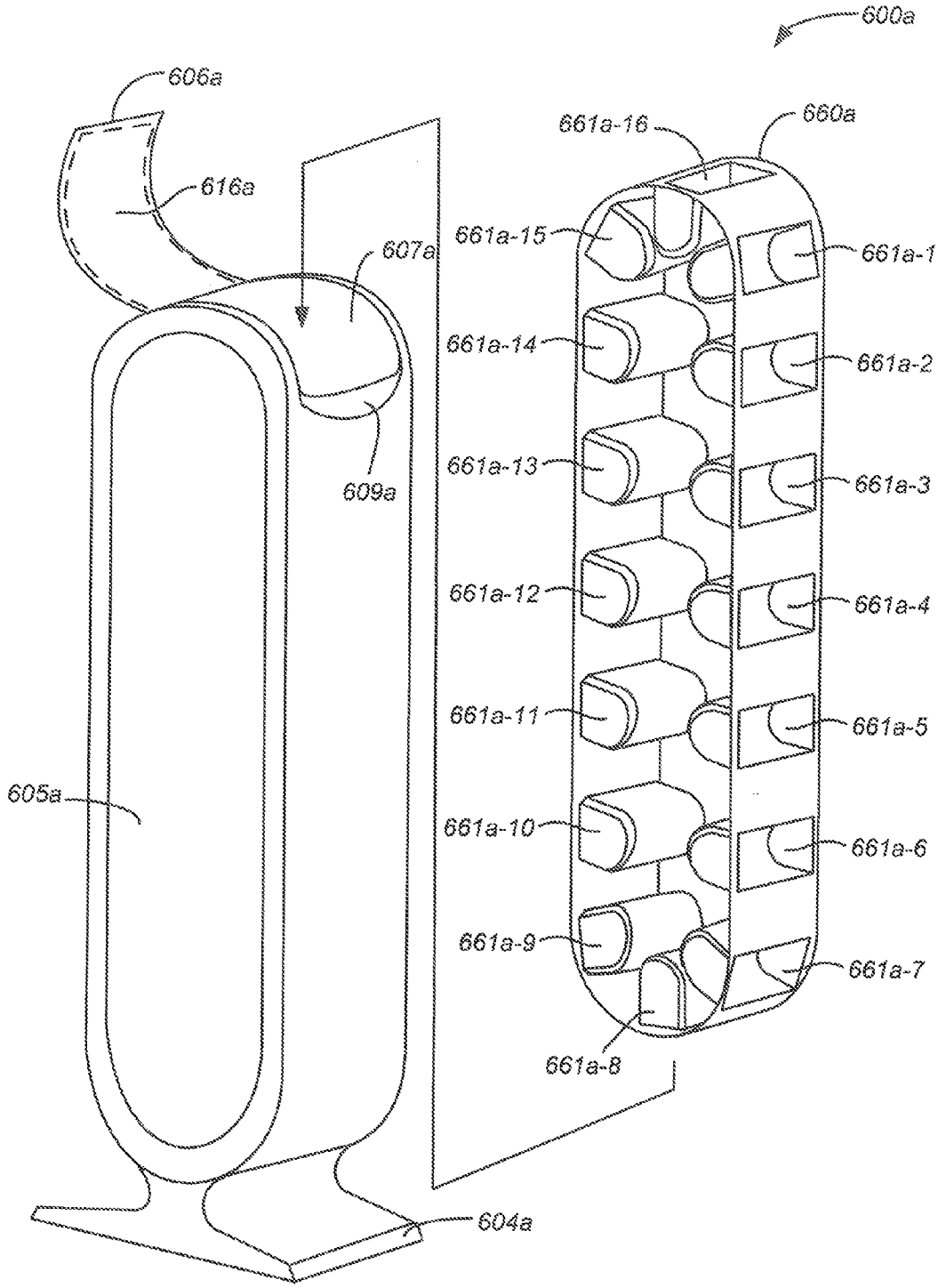
FIGS. 6A-6B are illustrative examples of a standing belt-type disposal unit with disposable cartridge refill, which may be in vertical, horizontal, round, elliptical or other shape in accordance with at least one embodiment.

FIG. 6A illustrates an illustrative example of a standing belt-type disposal unit in accordance with at least one embodiment. The example embodiment includes an outer container 605*a* which can be operably connected with a base 604*a*, or without a base. The container further includes a cover, the top of which 605*a* and the inside 616*a* any include different membranes or seals to help seal the odors. A cartridge component, such as a freestanding vertically presented component 660*a* includes multiple individual compartments 661*a*-1 through 661*a*-16 that are rotated within the tower structure in a vertical belt type rotation. The cartridge component is configured to be wholly removable without have to handle the contents of the compartments and is replaceable after it is used. The cartridge 660*a* is placed inside the outer compartment opening 907*a* and enclosed inside by closing the cover 906*a* meeting with the inner lid component 609*a*.

Figure 6B:
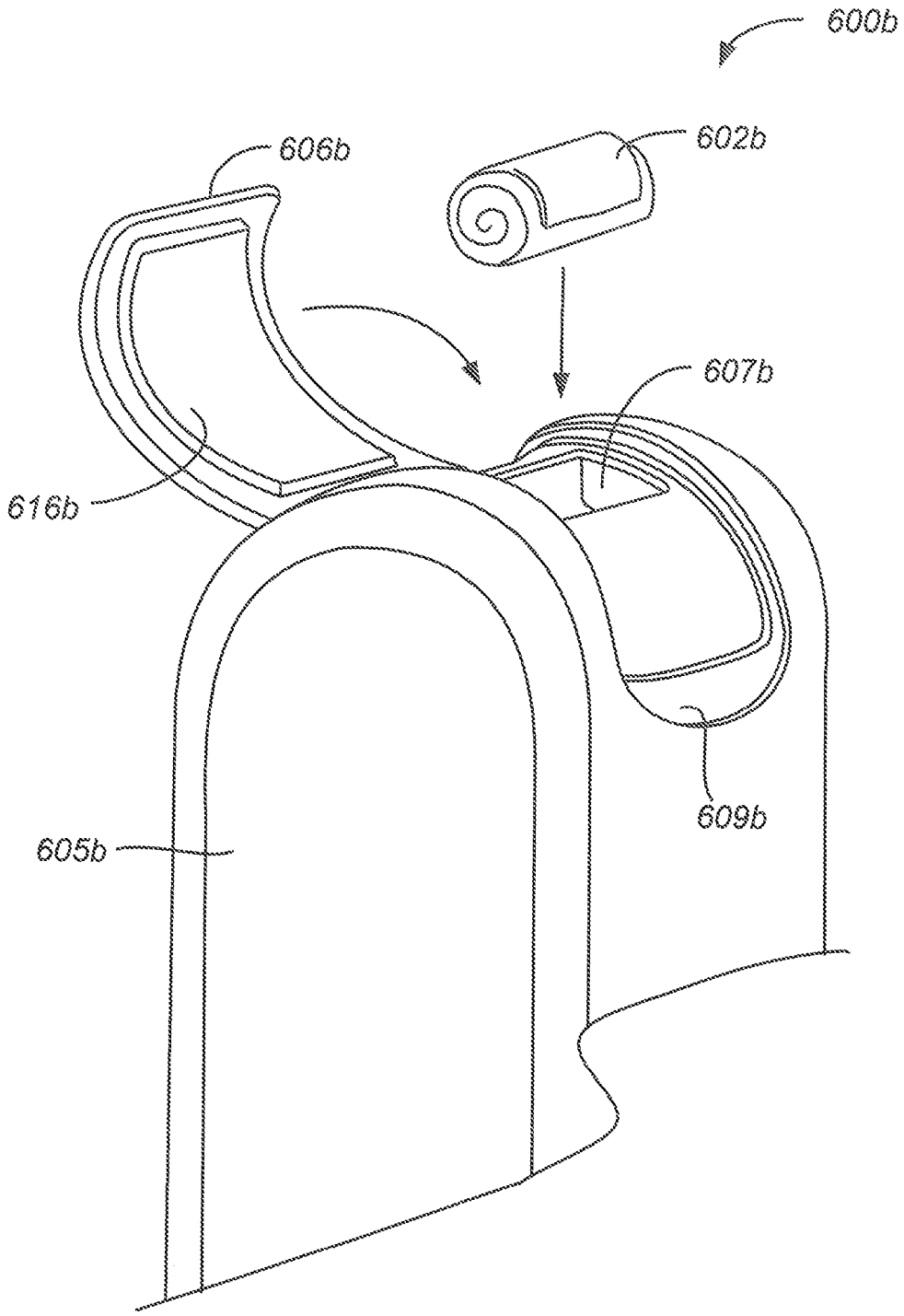

FIG. 6B is an illustrative example of a standing belt-type disposal unit in accordance with at least one embodiment 600*b*. Example embodiments of FIG. 6B disclose the outer container 605*b* already in set-up condition with the cartridge 660 located inside. A user can place a used personal hygiene product 602*b* within the outer compartment opening 607*b* at which point the cover 606*b* is closed forward to inter-seal with the lid component 609*b*. Upon closure of the cover, or approximately before or after closure, the lid is used to index the belt (cartridge) 660*a* as described and illustrated in FIG. 6A, to a next open and clean chamber compartment 661. Further example embodiments may include the inside of the cover 616*b* as being or containing an adhesive or other closure type that will help maintain odors and cleanliness.

Figure 7A:
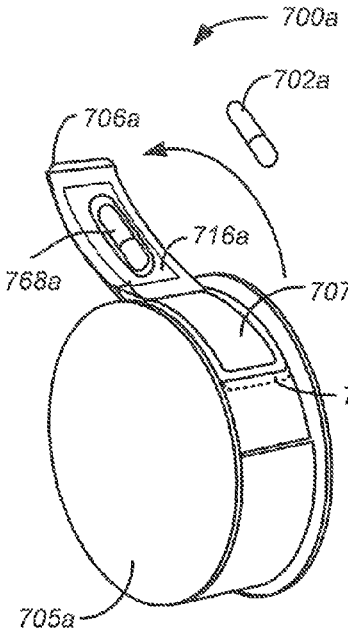
FIGS. 7A-7C are illustrative examples of a wall mounted or floor standing rotating disposal unit with disposable cartridge refill in accordance with at least one embodiment.

FIG. 7A a wall mounted, freestanding, or pedestal mounted waste disposal apparatus in accordance with at least one embodiment 700*a*. The waste disposal apparatus includes as an outer container 705 that is used for receiving used personal hygiene products 702*a* via an outer compartment opening 707*a*. The container 705 will include a type of cartridge or cassette used for separating the soiled products from view (See FIG. 7C). Once the personal hygiene product 702*a* has been inserted into the cartridge, the cover 706*a* is closed down to a tab 764*a*, which is later used for reopening the cover. Upon closing the cover, the cartridge or cassette is ratcheted one position (either forward or backwards) in order to provide a clean cartridge for the next use. Additional example embodiments include the inner portion of the cover 716*a* including an adhesive or other closing mechanism, for example a magnetic mechanism, that helps prevent escape and makes the unit slightly more difficult for small children to play with. Alternative example embodiments of the waste disposal apparatus of FIG. 7A may include a compartment 768*a* that may be used to store tampons for easy access to a fresh product after disposing of a soiled one. In some example embodiments, as the handle apparatus is rotated, possibly by a handle (not shown) or possibly by the ratcheting method of opening and closing the cover, in the determined direction, each slot or chamber that is already used can be sealed individually using an adhesive or other sealing mechanism or the entire cartridge component or cassette can be sealed in their entirety.

Figure 7B:
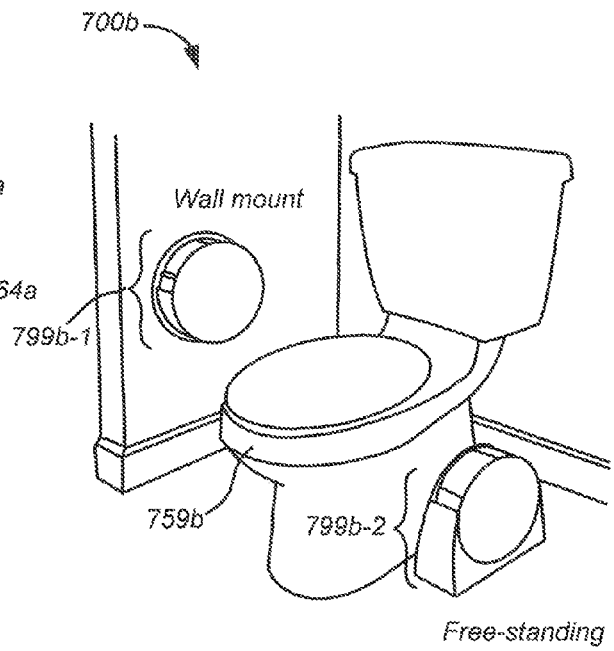

FIG. 7B is an illustrative example of a wall mounted or floor standing rotating disposal unit in accordance with at least one embodiment 700*b*. In one example embodiment, the waste disposal apparatus may be wall mounted 799*b*-1 or may be freestanding 799*b*-2, or both of which could be located in a bathroom in proximity to a toilet 759*b*. Alternative example embodiments of the present invention can be a freestanding unit, a wall-mounted unit, a mobile unit, a container capable of frequent movement, such as placement on the floor versus a table versus attachment to a wall.

Figure 7C:
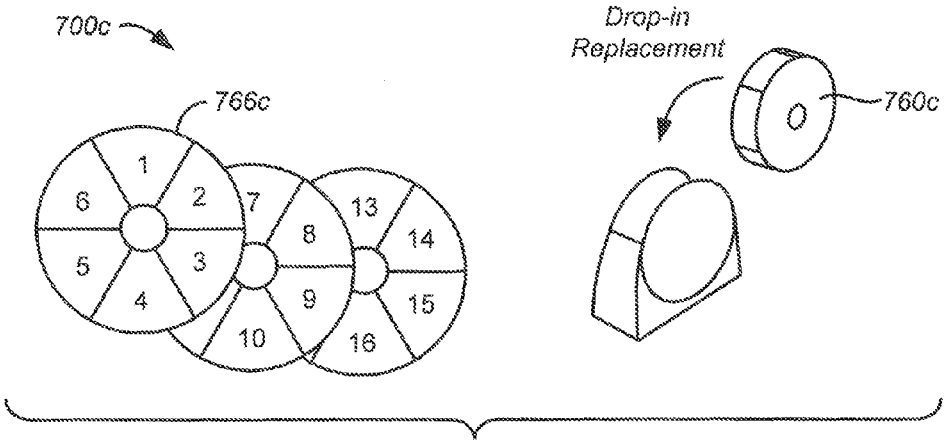

FIG. 7C is an illustrative example of a wall mounted or floor standing rotating disposal unit in accordance with at least one embodiment 700*c*. An example embodiment includes two types of refill types that may be included or used in the waste disposal apparatus of FIG. 7A. A first replacement type is a cassette or group of cassettes 766*c* that each contains a number of compartments or slots to receive soiled products. The cassettes can be used to refill the wall mounted apparatus by removing a front cover from the apparatus. A second replacement type is a drop-in replacement that is a cartridge component 760*c* that can be purchased and placed directly on the freestanding apparatus, such as 799*b*-2 as described and illustrated in connection with FIG. 7B.

Alternative example embodiments of the present invention could include an integrated sealer or mechanism for easy sealing of used contents for removal. Example embodiments of the present invention may be made of biodegradable materials. Example embodiments of the present invention may include a symbol or indication upon the level of contents reaching a limit or suggested time since last use. For example, an indicator light at a certain percentage filled, weight reached, or time since last change (or other point) that can be easily and discretely used to notify the contents need to be removed.

Figure 8A:
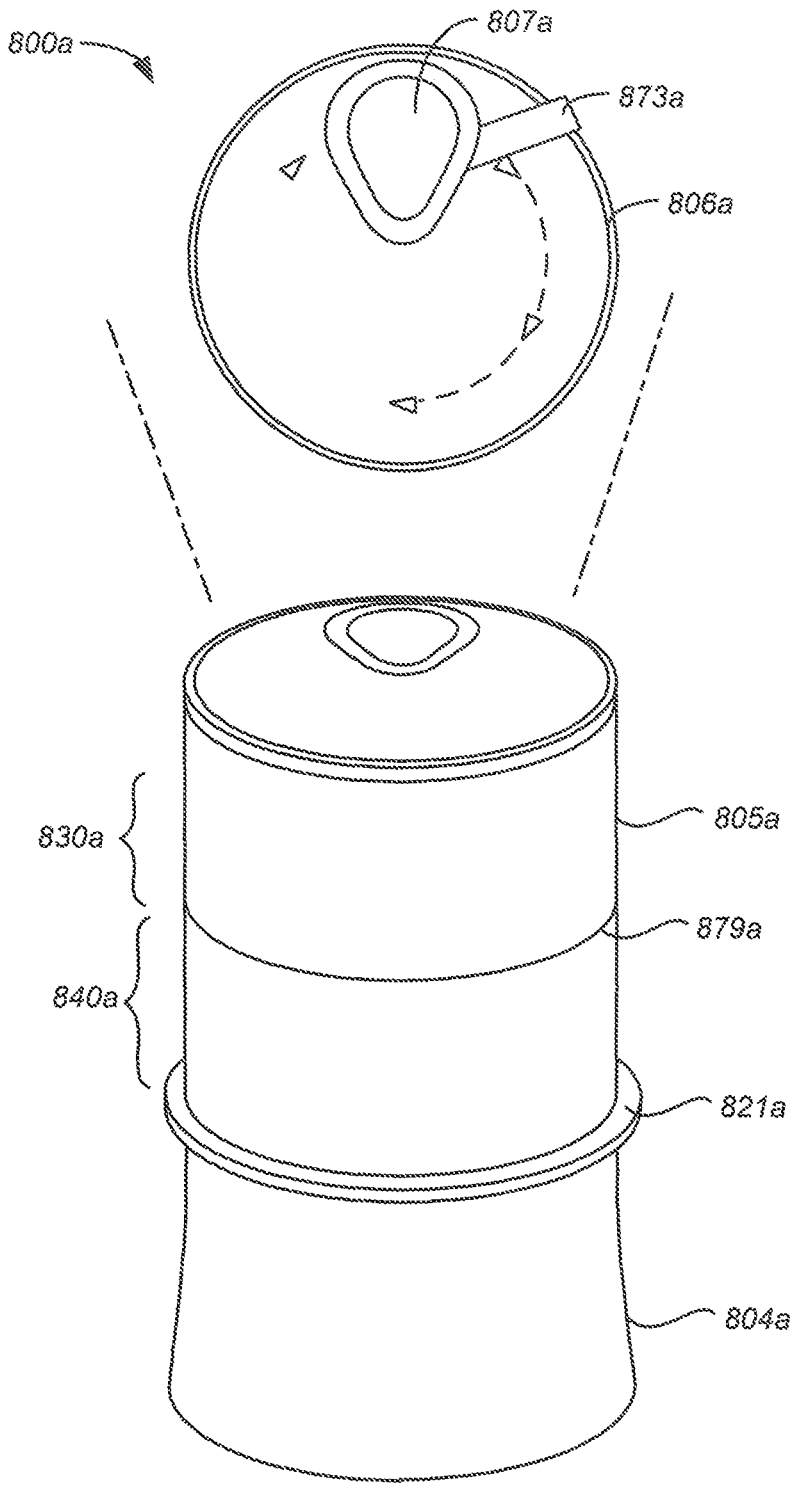
FIGS. 8A-8C are illustrative examples of an invertible pod storage disposal unit in accordance with at least one embodiment.

FIG. 8A illustrates an example waste disposal apparatus configured to receive a personal hygiene product at a first stage and pass the product to a second stage for longer-term and additional room storage 800*a*. For example, further embodiments are configured as a two-stage disposal process. The two-stage process is composed of an outer container 805*a* including a primary chamber 830*a* where the soiled material is inserted and a secondary chamber 840*a* where the soiled material is held until the waste disposal apparatus is emptied.

Upon opening of a container, the primary chamber is exposed to the user. In its first state, it is empty and ready to receive soiled material. The primary chamber also blocks and seals the secondary chamber so that odor does not emanate from the secondary chamber acting as the longer-term storage chamber. When the cover 806*a* and opening of the cover 807*a* is opened, one compartment of the primary chamber is s presented to the user in the empty state (see FIG. 8C). The user inserts the soiled material into the opening 807*a* and then closes the lid/opening by rotating the cover 806*a* in a specified direction, optionally using a handle 873*a* interconnected with the cover 806*a*.

In some example embodiments, as the handle 873*a* is rotated in the determined direction, each slot or chamber that is already used can be sealed individually using an adhesive or other sealing mechanism or the entire cartridge component, such as components 860*b* and 860*c*, can be sealed in their entirety. It should be noted that FIG. 8A illustrates the cover being rotated in a clockwise direction, alternative embodiments may allow the cover to be rotated in a counter-clockwise direction. Upon closing the cover 806*a*, the soiled material is transferred into the secondary chamber for longer-term storage and the primary chamber is empty and ready for the next insertion process. The container 805*a* further includes a dividing component separating the two compartments 830*a* and 840*a*, a base 804*a* and a removable base structure 821*a*, which can be removed from the outer container 805*a* in order to release the storage cartridge, such as the cartridge 860*b* and replace the cartridge with a fresh one. Alternatively, removable base 821*a* can be used to release all of the used products from the secondary storage 840*b*, but leave the cartridge container 860*b* for reuse. The cartridge container 860*b* could be a reusable, washable component.

Figure 8B:
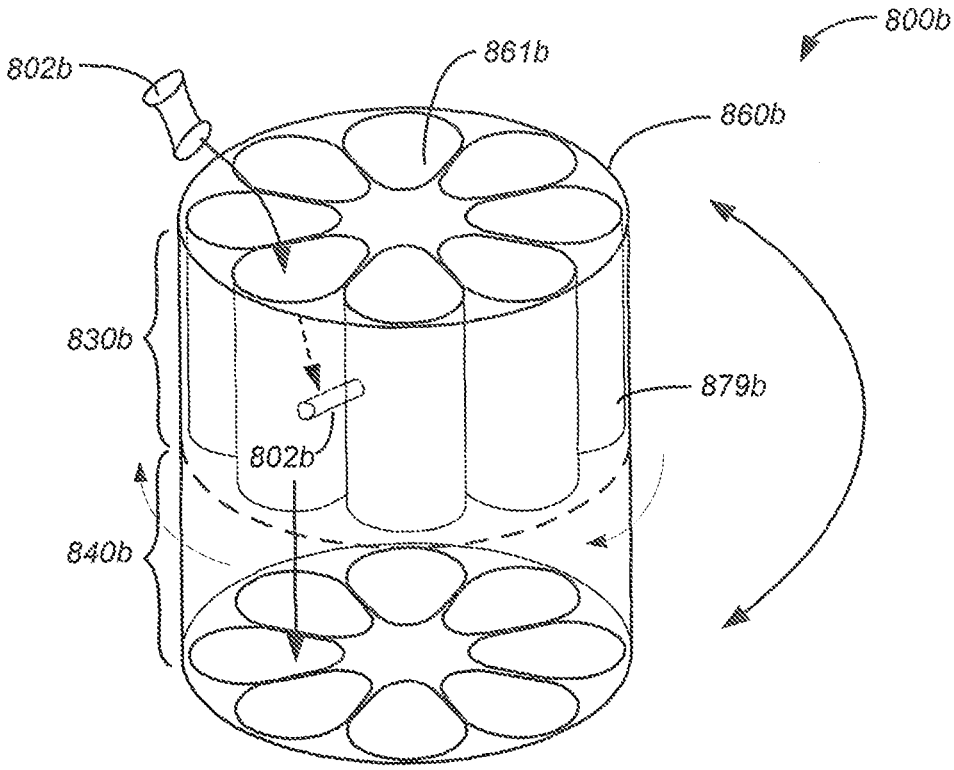

FIG. 8B is an illustrative example of an invertible pod storage disposal unit in accordance with at least one embodiment 800*b*. The example embodiment of FIG. 8B is a cartridge container 860*b* including two storage components, a primary storage compartment 830*b* and a secondary storage compartment 840*b*. The two storage compartments 830*b* and 840*b* can be, in one example embodiment, divided in half on a horizontal plane by a dividing component seal 879*b*, which can be employed to separate out the first and second storage compartments. As a personal hygiene product, such as a tampon 802*b* is placed into an individual compartment 861, via an opening 807*a* as described and illustrated in connection with FIG. 8A, the product drops through the first compartment 830*b* and, upon rotating of the handle, drops into the second compartment 840*b* for longer-term storage. While a certain number of cartridge compartments are illustrated herein, it will be known by those of skill in the art that any number of suitable cartridge components can be implemented according to the methods and systems provided and described herein.

In alternative example embodiments, the entire container is manufactured out of a paperboard material, such as corrugate, carton-type materials, or other such paperboard products, likely coated to provide an attractive outer shell. When the unit is filled, at capacity, or when it is desired, the entire device (container/unit) is intended to be thrown out without opening the unit, moving any linings or such or any other interaction between the user and the hazardous materials or waste products previously placed within. The unit can have a sealing mechanism whereby the mechanism is part of the outer structure of the container, lifts up and seals against each other and become handles for taking out the used container discretely. This can provide for future environmental use as the entire unit may be collected by some terracyling type group for safer waste control. The device can be sold in the store or shipped to the consumer erected or in a flattened state. The paperboard material can also contain odor-neutralizing chemicals to reduce and manage the odor from the soiled materials. The opening to the unit is an elongated slot across the top of the unit with a flexible film in the center. The opening can be stretched open with the flexibility of the paperboard to insert the soiled materials.

Figure 8C:
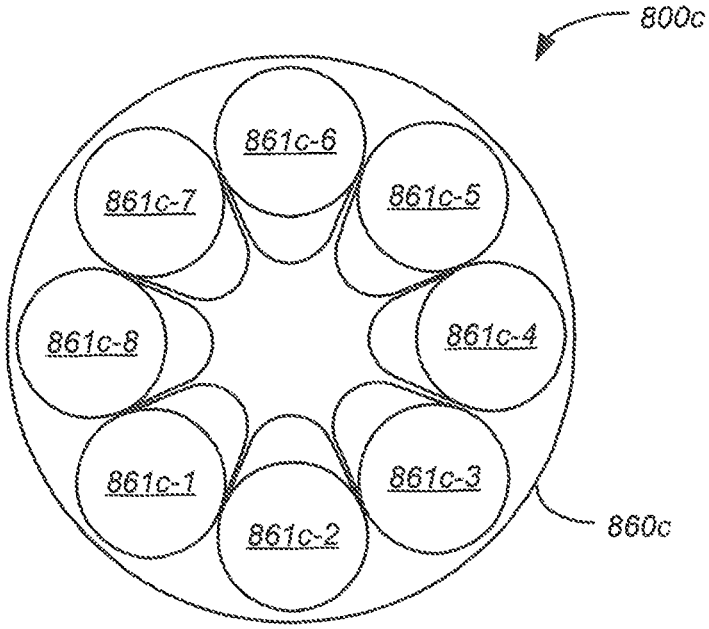

FIG. 8C is a cross sectional view of the invertible pod storage disposal unit as shown in the example embodiment of FIG. 8B. Specifically, the individual compartments 861*c*-1 through 861*c*-8 are used to receive soiled personal hygiene products via an entry point in a cover as illustrated and described in connection with FIG. 8A.

An alternative example embodiment includes an external view of this embodiment showing a dial that is turned to progress the soiled material into the storage chamber. The dial mechanism can be of many shapes, sizes and with many different kinds of features improving the ability to turn the wheel.

Alternative example embodiments of the present invention include a compartment or component area of the unit that includes a small suction device, such as a vacuum or compressor that activates upon closure of the top portion of the unit. For example, some such example embodiments enable a user to place the used personal care product into the receptacle, and, upon closure of a top portion door or drawer, a small suction occurs to remove possible upward odor release. Some such example embodiments may include a filter layer, such as an air filter, trap, etc. that may further enable odor removal and (trapping). This may also house a liquid odor neutralizing solution that sprays on the internal area to prevent any odor build up or head space wafting upon opening. This should also help prevent the unit from absorbing any odors, a common problem in current plastic material containers.

Alternative example embodiments of the present invention include a storage compartment that may be connected to and separated from the waste disposal apparatus such that personal care products may be discretely placed and stored in the same container, or additional compartment of the container.

Example embodiments as presented herein may be composed of many types of materials, for example: Manmade fiber materials both woven and non-woven (e.g., air laid, hydro entangled, chemical-bond, etc.). Manmade materials such as polymers and plastic resin like Acrylonitrile butadiene styrene (ABS), Low Density Polyethylene (LDPE), Linear Low Density Polyethylene (LLDPE), Styrene, Polyethylene and Polypropylene. Biodegradable polymers such as PolyLactic acid (PLA), 3-hydroxypropionic acid P(3-HP), and similar materials. Natural fibers such as paperboard, layered paperboard and bamboo (virgin and recycled). Hydrophobic coatings that prevent moisture leakage. Manmade and Natural anti-bacterial and anti-microbial agents to prevent bacterial growth (coating and additive) and/or unique attachment methodology such as Nano Technology.

Alternative example embodiments of the present invention include a product or component that neutralizes odor. For example, the container may be lined with or combined with an air freshener that may neutralize the inside of the container. Other such odor protectants may be used, for example, at least one of a non-toxic, non-allergenic, biodegradable, fragrance-free product added onto the surface of the unit, integrated with the unit material, coated on at least a portion of the unit, or similar manners. The unit should have multiple layers of protection with an antibacterial and anti-microbial pail, a moisture barrier between the pail and disposable and a deodorizer/neutralizer in the top of the disposable. Alternative example embodiments of the present invention include a natural and/or artificial material for absorbing odor, such as charcoal or a replaceable odor eliminator can be included therein.

Alternative example embodiments of the present invention further include an odor neutralizing liquid formulation spray is used to treat portions of the container in order to manage odor. The treatment can be automatic upon opening or closing of the container. The treatment can further be manually activated by a user when odor increases to the user's dislike. The treatment can further be time based or weight based and released to manage odor that is developed over time. The spray material can be recharged by removing an empty container with the formulation and replacing it with a full container. Further example embodiments of the present invention include a lining or bag within the receptacle, which contains or is coated with an odor neutralizer. Further example embodiments can include an odor neutralizing substance coated on internal and/or external surfaces of the receptacle.

Alternative example embodiments of the present invention can include a personal code to be entered or enabled on the receptacle in order for the receptacle to open, such as a battery operated, mechanical, or electrically operated receptacle. Such a code-type mechanism could be a hand entered code or change of physical items on the receptacle, a primitive lock. Other such example embodiments could include multiple components where a code or lock is required before the disposal area of the receptacle is. For example, a used adult care product enters a receiving mechanism in the receptacle and is placed into a storing mechanism of the receptacle that is separated and/or distinct from the receiving mechanism. In order for a user to view or dispose of the used contents, a code or lock would be entered/used to reach this portion of the receptacle. Alternative example embodiments of the present invention may include a concealed compartment, such as a rear-hidden compartment or a locked compartment that provides for further discretion and privacy such that the soiled products cannot easily be seen by a component mistakenly opened or poorly closed/sealed.

Alternative example embodiments of the present invention can be configured based on the concepts surrounding the "Lotus Effect" regarding the field of "super-hydrophobicity," which is a scientific property of materials able to maintain bacteria free surfaces. External and/or internal surfaces of an example embodiment of the present invention can be used based on this property and can be "self-cleaning surfaces" such that contamination, bacteria, odor, etc. can be easily removed as substances will not "stick" to the material. Common equations and scientific models in the field of super-hydrophobicity include Wenzel's Model and Cassie's Model. In other words, some such example embodiments of the present invention could mimic the natural effects of Lotus leaves and the surfaces of the present invention could be able to repel microbial through the texture or finish.

Further embodiments can be envisioned to one of ordinary skill in the art after reading this disclosure. In other embodiments, combinations or sub-combinations of the above-disclosed example embodiments can be advantageously made. The example arrangements of components are shown for purposes of illustration and it should be understood that combinations, additions, re-arrangements, and the like are contemplated in alternative embodiments of the present invention. Thus, while the example embodiments have been described with respect to exemplary embodiments, one skilled in the art will recognize that numerous modifications are possible. It will, however, be evident that various modifications and changes may be made thereunto without departing from the broader spirit and scope of the invention as set forth in the claims and that the invention is intended to cover all modifications and equivalents within the scope of the following claims.

What is claimed is:

1. A waste disposal apparatus configured to receive bodily waste products, the waste disposal apparatus comprising:

a housing compartment to be operably connected with a waste containment compartment;

an attachment component to interlock with the waste containment compartment; and an opening in the housing compartment, the opening leading to at least two mechanisms, comprising at least a first movable mechanism and a second movable mechanism, wherein the first movable mechanism, when engaged by a user, is moved to an open position and is configured to engage the second movable mechanism to an open position, wherein the first movable mechanism and the second movable mechanism return to a closed position when the first movable mechanism is no longer engaged by the user, and wherein the second movable mechanism is operably connected with a sealing mechanism, wherein when the first movable mechanism is in the closed position, the sealing mechanism is activated and seals the second movable mechanism.

2. The waste disposal apparatus according to claim 1, wherein the waste containment compartment is wholly removable from the housing compartment and further comprising:

a movable lid to expose an opening in the waste containment compartment; and a second attachment component to interlock with the housing compartment, wherein the second attachment component includes a hinge configured to be folded to seal the opening to the waste containment compartment.

3. The waste disposal apparatus of claim 1, wherein a housing receptacle and the opening to the waste containment compartment are sizeable to receive bodily waste products.

4. A waste disposal apparatus having an opening for receiving waste products, the waste disposal apparatus comprising:

a housing receptacle having an opening to a containment space, the containment space being concealed/enclosed on all sides except for the opening;

a cover for the opening that is operably connected to the housing, the cover being a movable component for movement in a vertical or horizontal position;

a shifting mechanism operably associated with the cover, the shifting mechanism configured to index one position in one direction when the cover is closed; and an inner compartment for holding a disposable liner, the inner compartment being accessible when the cover is in an open position, wherein the disposable liner is a belt mechanism containing depressed compartments for receiving the waste products and wherein the belt mechanism is fully replaceable without having to remove the inner compartment.

5. The apparatus according to claim 4, wherein the disposable liner includes expandable compartments that expand from a closed position upon entry of an object.

6. The apparatus according to claim 4, wherein the disposable liner being associated with the shifting mechanism, in a manner that enables the disposable liner to receive waste product each time and the shifting mechanism rotates one position.

7. The apparatus according to claim 4, wherein the cover for the opening is operable by a sensor.

8. The waste disposal apparatus of claim 4, wherein the housing receptacle includes an external mechanism for attaching to an object.

9. The waste disposal apparatus of claim 4, wherein the cover is a rotating cover, such that the shifting mechanism shifts in a circular motion in order to reveal a next position.

10. The waste disposal apparatus of claim 4, further comprising a second housing receptacle operably attachable to a side or bottom of the housing receptacle and is configured to include an unused compartment for storing clean components.

11. The waste disposal apparatus of claim 4, wherein a second housing receptacle is a storable component configured to attach to additional components operably.

12. A waste disposal apparatus having an opening for receiving waste products, the waste disposal apparatus comprising:

a housing receptacle having an opening to a containment space, the containment space being concealed/enclosed on all sides except for the opening;

a cover for the opening that is operably connected to the housing, the cover being a movable component for movement in a vertical or horizontal position;

a shifting mechanism operably associated with the cover, the shifting mechanism configured to index one position in one direction when the cover is closed; and an inner compartment for holding a disposable liner, the inner compartment being accessible when the cover is in an open position a sealing flap operably connected with the cover, the sealing flap providing for waste containment, the sealing flap being movable for disposal with the disposable liner.

13. A waste disposal apparatus having an opening for receiving waste products, the waste disposal apparatus comprising:

a housing receptacle having an opening to a containment space, the containment space being concealed/enclosed on all sides except for the opening;

a cover for the opening that is operably connected to the housing, the cover being a movable component for movement in a vertical or horizontal position;

a shifting mechanism operably associated with the cover, the shifting mechanism configured to index one position in one direction when the cover is closed; and an inner compartment for holding a disposable liner, the inner compartment being accessible when the cover is in an open position, wherein the shifting mechanism is configured to stop shifting when the disposable liner is full.

14. A waste disposal apparatus having an opening for receiving waste products, the waste disposal apparatus comprising:

a housing receptacle having an opening to a containment space, the containment space being concealed/enclosed on all sides except for the opening, wherein the housing receptacle is interconnected with a hanging mechanism adjustable to be placed over any number of objects;

a cover for the opening that is operably connected to the housing, the cover being a movable component for movement in a vertical or horizontal position;

a shifting mechanism operably associated with the cover, the shifting mechanism configured to index one position in one direction when the cover is closed; and an inner compartment for holding a disposable liner, the inner compartment being accessible when the cover is in an open position.

15. A waste disposal apparatus configured to receive a personal hygiene waste product, the waste disposal apparatus comprising:

a first containment component, the first containment component including a cover configured to open in a vertical or horizontal direction upon engagement with an opening mechanism operably interconnected with the first containment component by a hinge component;

a second containment component configured to be contained in the first containment component, the second containment component being a disposable containment compartment interconnected with a disposable opening collar configured to interlock with a removable covering mechanism temporarily;

a first engagement mechanism connected with the removable covering mechanism, the first engagement mechanism being engaged by a personal hygiene product being placed within the disposable opening;

a second engagement mechanism connected with the second containment component, the second engagement mechanism configured to be contained in the first engagement mechanism and the second engagement mechanism being engaged by movement of the first engagement mechanism; and the first and second engagement mechanisms configured to disengage automatically upon closure of the cover.

16. The waste disposal apparatus of claim 15 wherein a second disposable containment compartment component including an expandable bag configured to receive a personal hygiene product, wherein the second engagement mechanism includes a cover that covers a top of the expandable bag in a manner concealing contents of the expandable bag.

17. The waste disposal apparatus of claim 16 wherein the first engagement mechanism covers the cover of the second engagement mechanism in a manner concealing the second engagement mechanism.

* * * * *